US009252494B2

(12) United States Patent
Hayashi et al.

(10) Patent No.: US 9,252,494 B2
(45) Date of Patent: Feb. 2, 2016

(54) FREQUENCY-VARIABLE ANTENNA CIRCUIT, ANTENNA DEVICE CONSTITUTING IT, AND WIRELESS COMMUNICATIONS APPARATUS COMPRISING IT

(75) Inventors: Kenji Hayashi, Tottori (JP); Hiroshi Okamoto, Tottori (JP); Hiroto Ideno, Tottori (JP)

(73) Assignee: HITACHI METALS, LTD., Tokyo (JP)

( * ) Notice: Subject to any disclaimer, the term of this patent is extended or adjusted under 35 U.S.C. 154(b) by 17 days.

(21) Appl. No.: 13/391,954

(22) PCT Filed: Nov. 15, 2010

(86) PCT No.: PCT/JP2010/070302

§ 371 (c)(1),
(2), (4) Date: Feb. 23, 2012

(87) PCT Pub. No.: WO2011/059088

PCT Pub. Date: May 19, 2011

(65) Prior Publication Data

US 2012/0146865 A1 Jun. 14, 2012

(30) Foreign Application Priority Data

Nov. 13, 2009 (JP) ..... 2009-260127
Aug. 6, 2010 (JP) ..... 2010-177561

(51) Int. Cl.
*H01Q 9/00* (2006.01)
*H01Q 9/42* (2006.01)
*H01Q 5/392* (2015.01)

(52) U.S. Cl.
CPC . *H01Q 9/42* (2013.01); *H01Q 5/392* (2015.01)

(58) Field of Classification Search
USPC ..... 343/750, 702, 745, 700 MS
See application file for complete search history.

(56) References Cited

U.S. PATENT DOCUMENTS 6,693,594 B2 * 2/2004 Pankinaho et al. .... 343/700 MS
6,819,290 B2 * 11/2004 Hani ..... H01Q 1/243 343/700 MS (Continued)

FOREIGN PATENT DOCUMENTS

CN 1197200 C 4/2005
CN 201247819 Y 5/2009

(Continued)

OTHER PUBLICATIONS

Chinese Patent Application issued Dec. 4, 2013 in Chinese Patent Application No. 201080051239.1.
International Search Report for PCT/JP2010/070302 dated Feb. 1, 2011.

*Primary Examiner* — Hoang V Nguyen
*Assistant Examiner* — Hai Tran
(74) *Attorney, Agent, or Firm* — Sughrue Mion, PLLC

(57) ABSTRACT

An antenna device comprising an antenna element disposed on a mounting board separate from a main circuit board, a coupling means disposed on the mounting board such that it is electromagnetically coupled to the antenna element, and a frequency-adjusting means disposed on the mounting board such that it is connected to the coupling means, the antenna element comprising first and second strip-shaped antenna elements integrally connected for sharing a feeding point, the second antenna element being shorter than the first antenna element; the coupling means being formed on a dielectric chip attached to the mounting board, and having a coupling electrode electromagnetically coupled to part of the first antenna element. The frequency-adjusting means comprises a parallel resonance circuit comprising a variable capacitance circuit and a first inductance element, and a second inductance element series-connected to the parallel resonance circuit.

19 Claims, 19 Drawing Sheets

(56) References Cited

U.S. PATENT DOCUMENTS

| | | | | |
|---|---|---|---|---|
| 7,136,020 | B2 * | 11/2006 | Yamaki | H01Q 9/285 343/700 MS |
| 2004/0201527 | A1 | 10/2004 | Hani et al. | |
| 2004/0246189 | A1 | 12/2004 | Tran | |
| 2005/0099347 | A1 | 5/2005 | Yamaki | |
| 2006/0197711 | A1 | 9/2006 | Sekiguchi et al. | |
| 2006/0246849 | A1 | 11/2006 | Tran | |
| 2008/0129639 | A1 * | 6/2008 | Mitsugi | 343/876 |
| 2010/0019582 | A1 | 1/2010 | Okanobu | |
| 2010/0053007 | A1 * | 3/2010 | Ni et al. | 343/745 |
| 2011/0102290 | A1 | 5/2011 | Milosavljevic | |

FOREIGN PATENT DOCUMENTS

| | | | |
|---|---|---|---|
| JP | 10-107671 | A | 4/1998 |
| JP | 2002-232232 | A | 8/2002 |
| JP | 2004-320611 | A | 11/2004 |
| JP | 2005-150937 | A | 6/2005 |
| JP | 2006-54639 | A | 2/2006 |
| JP | 2006-523426 | A | 10/2006 |
| JP | 2007-194995 | A | 8/2007 |
| JP | 2008-166877 | A | 7/2008 |
| WO | WO 2004/091046 | A1 | 10/2004 |
| WO | WO 2009/027579 | A1 | 3/2009 |

* cited by examiner

FREQUENCY-VARIABLE ANTENNA CIRCUIT, ANTENNA DEVICE CONSTITUTING IT, AND WIRELESS COMMUNICATIONS APPARATUS COMPRISING IT

CROSS REFERENCE TO RELATED APPLICATIONS

This application is a National Stage of International Application No. PCT/JP2010/070302 filed Nov. 15, 2010, claiming priority based on Japanese Patent Application Nos. 2009-260127 filed Nov. 13, 2009 and 2010-177561 filed Aug. 6, 2010, the contents of all of which are incorporated herein by reference in their entirety.

FIELD OF THE INVENTION

The present invention relates to a frequency-variable antenna circuit capable of changing a resonance frequency, an antenna device constituting at least part thereof, and a wireless communications apparatus comprising such antenna device for handling pluralities of frequency bands.

BACKGROUND OF THE INVENTION

Because of the rapid expansion of the use of wireless communications apparatuses such as cell phones, etc., more frequency band ranges have become used for communications systems. Particularly, increasing numbers of cell phones handling pluralities of transmitting/receiving bands, such as dual-band, triple-band and quad-band cell phones, have recently got used. For example, quad-band cell phones for communications systems in a GSM (registered trademark) 850/900 band, a DCS band, a PCS band and a UMTS band need antennas (multi-band antennas) capable of handling these frequency bands, because the GSM (registered trademark) 850/900 band uses a frequency band of 824-960 MHz, the DCS band uses a frequency band of 1710-1850 MHz, the PCS band uses a frequency band of 1850-1990 MHz, and the UMTS band uses a frequency band of 1920-2170 MHz.

An antenna element (radiation element, radiation electrode, or radiation line, which may be called simply "line") constituting an antenna usually has resonance in a fundamental frequency (fundamental mode), and resonance in higher frequencies (higher mode). For example, the fundamental mode has a ¼ wavelength, and the higher mode has a ¾ wavelength. When fundamental-mode resonance is obtained, for example, in a GSM (registered trademark) 850/900 band in a multi-band antenna constituted by one antenna element, a DCS band, etc. correspond to higher-mode resonance. However, because the DCS band, the PCS band and the UMTS band have frequencies about 2-2.5 times that of the GSM (registered trademark) band, failing to meet the condition that pluralities of frequency bands have a 1:3 relation, they are not simply applicable to higher-mode resonance. Also, in higher-mode resonance, a bandwidth providing a proper VSWR (voltage standing wave ratio) is narrow.

Because the GSM (registered trademark) 850/900 band has a frequency bandwidth of 136 MHz and a center frequency of 892 MHz, its relative bandwidth is about 15.3% [136 MHz/892 MHz]. Also, because the DCS band, the PCS band and the UMTS Band 1 band have a frequency bandwidth of 460 MHz and a center frequency of 1940 MHz, their relative bandwidth is about 23.7% [460 MHz/1940 MHz]. In such frequency bands, impedance matching is difficult to achieve by resonance with one antenna element, and its bandwidth is insufficient.

Against such problems, JP 10-107671 A proposes an antenna shown in FIG. 35. This antenna comprises a feeding cable 7, a flat radiation plate 4 (antenna element) disposed in parallel to a ground electrode GND, connected to the feeding cable 7 at a feeding point A, and grounded via a short-circuiting pin 8, and a frequency-adjusting means 30 disposed between an open end of the flat radiation plate 4 and the ground electrode GND. As the equivalent circuit of FIG. 36 shows, the frequency-adjusting means 30 comprises a variable capacitance diode CR1, and the control of bias current to the variable capacitance diode CR1 makes it possible to adjust the resonance frequency of the antenna in different frequency bands. The variable capacitance diode may be called "varicap diode" or "varactor diode."

JP 2002-232232 A discloses, as shown in FIGS. 37 and 38, a multi-band antenna comprising a first antenna element 3 for a first frequency band and a second antenna element 4 for a second frequency band sharing a feeding point A and grounded at one end via a short-circuiting path 8; a metal plate 2 opposing the antenna elements 3, 4 via an insulator 6 and a variable capacitance diode CR1 connected to the metal plate 2, which are disposed between the first and second antenna elements 3, 4 and a ground electrode GND. Because grounded capacitance can be changed by controlling bias current supplied to the variable capacitance diode CR1, this multi-band antenna can be used in pluralities of frequency bands.

The antennas disclosed in JP 10-107671 A and JP 2002-232232 A can be used in pluralities of frequency bands with grounded capacitance changed by a variable capacitance diode disposed in series between the antenna element and the ground electrode. The variable capacitance diode has electrostatic capacitance continuously changing by the application of reverse bias voltage. However, because power consumption and battery voltage have been reduced in mobile communications apparatuses such as cell phones, etc., resulting in smaller change width of voltage applied to variable capacitance diodes, the mere arrangement of a variable capacitance diode between an antenna element and a ground electrode restricts the variation range of electrostatic capacitance, so that tuning in a desired range is likely difficult. Also, the change of electrostatic capacitance is not inversely proportional to voltage applied, making the adjustment of resonance frequency also difficult.

Further, the antenna disclosed in JP 2002-232232 A comprising pluralities of antenna elements arranged on a plane and a metal plate 2 opposing the antenna elements via an insulator 6 suffer the problem of a large size.

As another example of multi-band antennas comprising pluralities of antenna elements, JP 2005-150937 A discloses, as shown in FIG. 39, an antenna comprising an antenna element 4 connected to a feeding point, a parasitic antenna element 5 electromagnetically-coupled to the antenna element 4, a ground-side electrode 21 between an open end K of the antenna element 4 and a ground electrode GND, and a switch means 22 for switching the connection of the ground-side electrode 21 to the ground electrode GND. With a resonance frequency in a fundamental frequency band based on the operation of the antenna element 4 variable depending on electrostatic capacitance between the ground-side electrode 21 and the open end K of the antenna element 4, higher frequency bands are expanded by multi-resonance with the parasitic antenna element 5. Also proposed is the adjustment of a resonance frequency according to a frequency used, by changing the capacitance of a variable capacitance diode disposed between the open end K of the antenna element 4 and the ground electrode GND. Thus, this antenna is operable as a multi-band antenna by the action of an antenna element and a parasitic antenna element electromagnetically-coupled to the antenna element, with a resonance frequency variable by changing electrostatic capacitance between the open end of the antenna element and a ground electrode. However, this antenna comprising an antenna element electromagnetically coupled to a parasitic antenna element suffers the problem that its VSWR characteristics are likely to deteriorate because the change of the resonance frequency of a low-frequency band leads to the change of the resonance frequency of a higher frequency band. Also, because the antenna element and the parasitic antenna element are arranged on the same plane, the antenna is disadvantageously large.

OBJECTS OF THE INVENTION

Accordingly, the first object of the present invention is to provide a frequency-variable antenna circuit capable of adjusting a resonance frequency in a desired range and suitable for wireless communications apparatuses such as cell phones, etc.

The second object of the present invention is to provide a small frequency-variable antenna circuit usable in a wide frequency band from a low-frequency band to a high-frequency band, a resonance frequency in the low-frequency band being variable with little influence on a resonance state in the high-frequency band, an antenna device used therein, and a wireless communications apparatus comprising it.

The third object of the present invention is to provide a wireless communications apparatus comprising such a frequency-variable antenna circuit (device).

SUMMARY OF THE INVENTION

The frequency-variable antenna circuit of the present invention comprises a first antenna element having one end acting as a feeding point and the other end acting as an open end, and a frequency-adjusting means coupled to the first antenna element via a coupling means; the frequency-adjusting means comprising a parallel resonance circuit comprising a variable capacitance circuit and a first inductance element, and a second inductance element series-connected to the parallel resonance circuit.

The coupling means is preferably any one of a connecting line, a capacitance element, an inductance element, and an electrode electromagnetically coupled to the first antenna element.

The frequency-variable antenna circuit of the present invention preferably comprises a control circuit for changing the capacitance of the variable capacitance circuit.

The frequency-variable antenna circuit of the present invention preferably comprises a detection means for detecting the change of the resonance frequency of the first antenna element, the control circuit feeding a control signal for changing capacitance based on the output of the detection means back to the variable capacitance circuit. A directional coupler, etc. may be used as a means for detecting the change of a resonance frequency to be tuned depending on the change of reflected waves of transmitting signals. To detect the change of the resonance frequency based on received signals, the change of the gain of received signals may be detected.

The frequency-variable antenna circuit of the present invention preferably further comprises a second antenna element integral with and shorter than the first antenna element and sharing the feeding point with the first antenna element, to provide multi-resonance comprising the resonance of the first antenna element and the resonance of the second antenna element, so that the frequency-variable antenna circuit acts as a multi-band one. The frequency-variable antenna circuit may have a structure comprising three or more antenna elements.

The first and second antenna elements preferably share part of a path from the feeding point.

The first antenna device of the present invention for constituting a frequency-variable antenna circuit comprises a first strip-shaped antenna element and a frequency-adjusting means coupled to the first antenna element via a coupling means; the frequency-adjusting means comprising a parallel resonance circuit comprising a variable capacitance circuit and a first inductance element, and a second inductance element series-connected to the parallel resonance circuit; the first antenna element having one end acting as a feeding point and the other end acting as an open end; and part of the first antenna element being electromagnetically coupled to the coupling means.

The antenna device of the present invention preferably further comprises a second strip-shaped antenna element shorter than the first antenna element and sharing the feeding point with the first antenna element, to provide multi-resonance comprising the resonance of the first antenna element and the resonance of the second antenna element, so that the frequency-variable antenna circuit acts as a multi-band one. Part of the first antenna element is preferably opposing the second antenna element with a predetermined gap.

The coupling means preferably has a coupling electrode formed on a support made of a dielectric material or a soft-magnetic material. A connecting electrode is preferably formed on the support with a predetermined gap to the coupling electrode, and connected to the first antenna element.

The antenna element and the coupling means are preferably disposed on a mounting board separate from a main circuit board. The variable capacitance circuit in the frequency-adjusting means is preferably disposed on the mounting board and connected to the coupling means via a connecting line.

The second antenna device of the present invention comprises an antenna element disposed on a mounting board separate from a main circuit board, a coupling means disposed on the mounting board such that it is electromagnetically coupled to the antenna element, and a frequency-adjusting means disposed on the mounting board such that it is connected to the coupling means, the antenna element comprises first and second strip-shaped antenna elements integrally connected for sharing a feeding point, the second antenna element being shorter than the first antenna element; and the coupling means being formed on a dielectric chip attached to the mounting board, and comprising a coupling electrode electromagnetically coupled to part of the first antenna element.

The electromagnetic coupling position of the coupling electrode to the first antenna element is not particularly restricted, but may be properly determined taking into consideration the current distribution of the first antenna element. The resonance frequency changes largely when the coupling electrode is positioned on the side of the open end of the first antenna element, and a large gain is obtained when the coupling electrode is positioned on the side of the feeding point.

The dielectric chip preferably comprises a line for connecting the coupling electrode to the frequency-adjusting means. The coupling electrode is preferably a strip electrode extending substantially in parallel to the first antenna element, part of the connecting line extending substantially in parallel to the coupling electrode. The connecting line is preferably a meandering line.

The first antenna element preferably has a turned portion. An auxiliary line preferably extends from the first antenna element at a bending point connected to the turned portion; the dielectric chip being in contact with part of the auxiliary line.

The wireless communications apparatus of the present invention comprises the above frequency-variable antenna circuit (device).

DESCRIPTION OF THE PREFERRED EMBODIMENTS

[1] Frequency-variable Antenna Circuit

Figure 1:
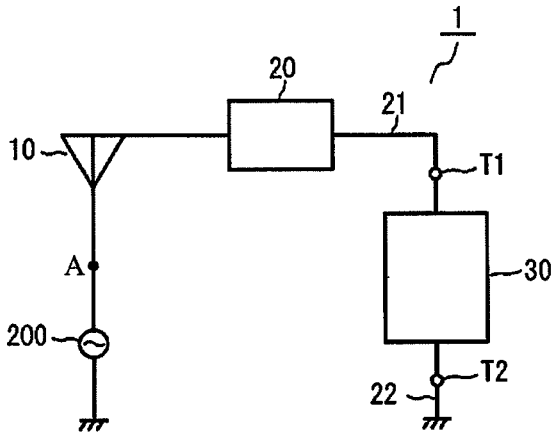
FIG. 1 is a schematic view showing one example of the frequency-variable antenna circuits of the present invention.
Figure 2:
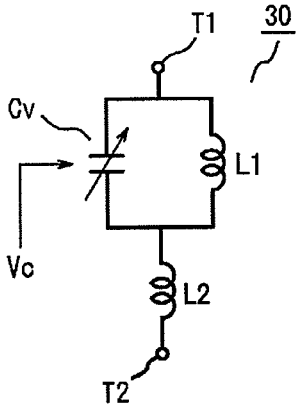
FIG. 2 is a schematic view showing one example of frequency-adjusting means used in the frequency-variable antenna circuit of the present invention.

FIG. 1 shows one example of the frequency-variable antenna circuits of the present invention. This frequency-variable antenna circuit 1 comprises an antenna element 10, a coupling means 20 electromagnetically coupled to the antenna element 10, and a frequency-adjusting means 30 connected to the coupling means 20 and a ground electrode GND. As shown in FIG. 2, the frequency-adjusting means 30 comprises a parallel circuit comprising a variable capacitance circuit Cv and a first inductance element L1, and a second inductance element L2 connected to the parallel circuit. With the parallel circuit on the side of the terminal T1, the second inductance element L2 is connected to the ground electrode GND via the terminal T2, but the second inductance element L2 may be on the side of the terminal T1. The coupling means 20 may be constituted by any one of a connecting line, a capacitance element, an inductance element, and an electrode electromagnetically coupled to the antenna element 10.

Figure 3:
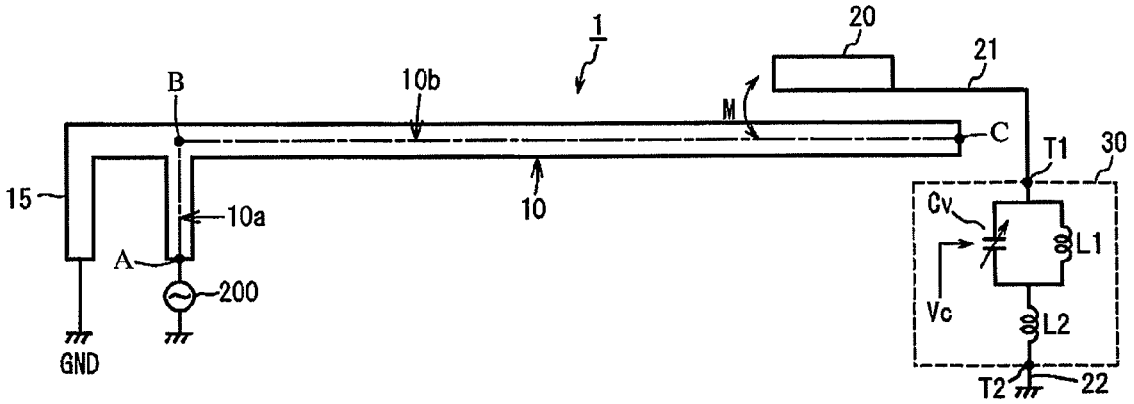
FIG. 3 is a view showing one example of antenna elements used in the frequency-variable antenna circuit of the present invention.

FIG. 3 shows one example of antenna elements 10 constituting the frequency-variable antenna circuit 1 of FIG. 1. Taking an inverted-F antenna for example, the antenna element 10 will be explained here without intention of restriction. The antenna element 10 may be, for example, a monopole antenna, an inverted-L antenna, a T antenna, etc. The antenna element 10 has a feeding point A at one end and an open end C at the other end, with a region 10*a* between the feeding point A and a bending point B, and a region 10*b* between the bending point B and the open end C. The region 10*b* extends substantially in parallel to the ground electrode GND. The antenna element 10 has a ground line 15 between the bending point B and the ground electrode GND. There is electromagnetic coupling M between the region 10*b* of the antenna element 10 and the coupling means 20. The antenna element 10 has a length (a total length of the region 10*a* and the region 10*b*) equal to about ¼ of a wavelength λ1 of a resonance frequency f1*r* in a fundamental frequency band, to be operated in a series resonance mode. Taking the fundamental frequency in a low-frequency band, for example, explanation will be made below.

Because the antenna element 10 in the form of an inverted-F antenna has a current distribution in series resonance, which is 0 at the open end C and maximum at a point (bending point B) connected to the ground line 15, the length of the region 10*b* predominantly determines the receiving and radiating behavior of the antenna element 10. Because impedance is in a short-circuited state with substantially zero voltage at the point connected to the ground line 15, the impedance of the antenna element 10 can be adjusted by changing the position of the point connected to the ground line 15.

Figure 4:
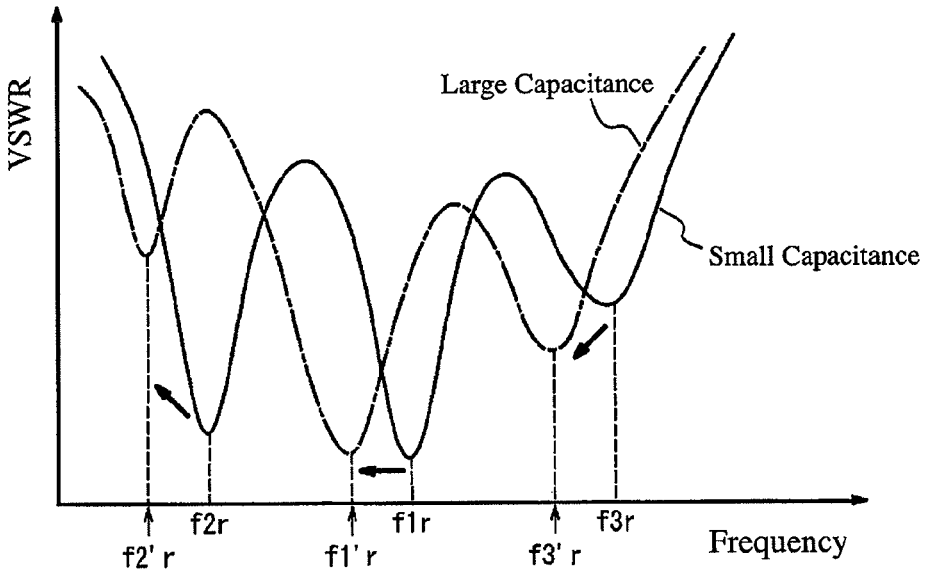
FIG. 4 is a graph schematically showing the VSWR characteristics of the frequency-variable antenna circuit of the present invention.

As shown in FIG. 4, there is resonance at pluralities of frequencies in the VSWR characteristics of the frequency-variable antenna circuit 1 when viewed from the feeding point A. In the frequency-adjusting means 30, the capacitance of the variable capacitance circuit Cv, and the inductance of the first and second inductance elements L1, L2 are set such that the resonance frequency f2*r* of a parallel circuit comprising the first inductance element L1 and the variable capacitance circuit Cv is lower than the resonance frequency f1*r* of the antenna element 10, that the resonance frequency f3*r* of a series resonance circuit comprising the variable capacitance circuit Cv and the second inductance element L2 is higher than the resonance frequency f1*r* of the antenna element 10, and that the resonance frequencies f2*r*, f3*r* do not exist in a low-frequency band.

The change of the capacitance of the variable capacitance circuit Cv results in the change of the resonance frequencies f2*r*, f3*r*. The resonance frequencies f2*r*, f3*r* shift toward lower frequency sides (f2*r*→f2'*r*, and f3*r*→f3'*r*) when the above capacitance increases, and toward higher frequency sides (f2'*r*→f2*r*, and f3'*r*→f3*r*) when the capacitance decreases. Simultaneously, the resonance frequency f1*r* of the antenna element 10 also shifts toward a lower frequency side (f1*r*→f1'*r*) or a higher frequency side (f1'*r*→f1*r*).

Although the resonance frequency f1*r* of the antenna element 10 can be changed by only either one of the parallel circuit and the series circuit, a range of changing the resonance frequency in a variable capacitance range of the variable capacitance circuit Cv is small when only the series circuit is used, sometimes making tuning in a desired frequency band difficult. On the other hand, when only the parallel circuit is used, the resonance frequency changes too much, it is difficult to control the resonance frequency f1*r* of the antenna element 10 with high precision.

Figure 5:
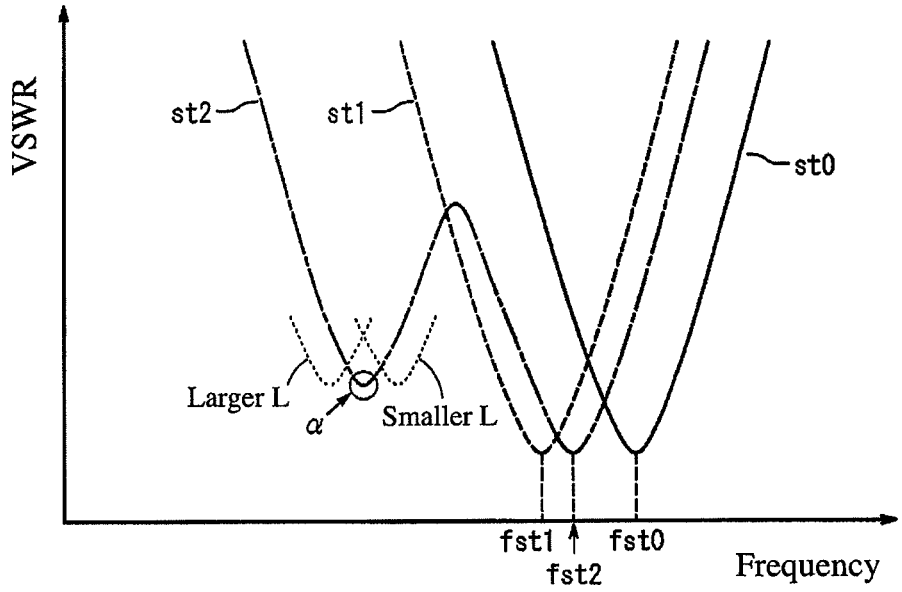
FIG. 5 is a graph schematically showing the change of VSWR characteristics by a frequency-adjusting means.
Figure 6:
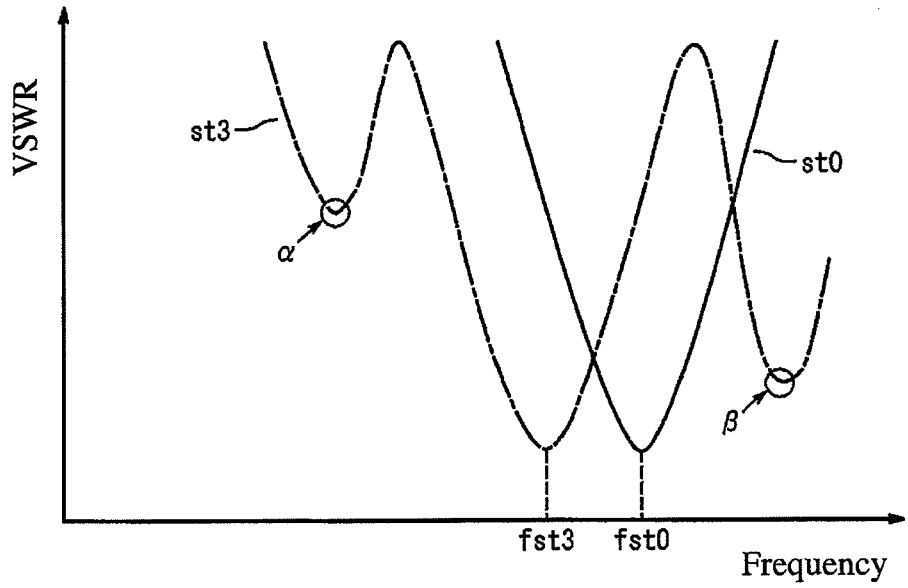
FIG. 6 is a graph schematically showing the change of VSWR characteristics by a frequency-adjusting means.

FIGS. 5 and 6 show the VSWR characteristics of antennas with different conditions. A curved solid line st0 shows the VSWR characteristics of a structure A constituted only by the antenna element 10, which is obtained by removing the frequency-adjusting means 30 and the coupling means 20 from the frequency-variable antenna circuit 1 shown in FIG. 3. A curved dotted line st1 shows the VSWR characteristics of a structure B constituted by the antenna element 10 and the coupling means 20, which is obtained by removing the frequency-adjusting means 30 from the frequency-variable antenna circuit 1. A curved chain line st2 shows the VSWR characteristics of a structure C constituted by the antenna element 10 and the coupling means 20 grounded via the inductance element L2. In FIG. 6, a curved chain line st3 shows the VSWR characteristics of a structure D, which is the same as the structure of the frequency-variable antenna circuit 1 shown in FIG. 3 except for replacing the variable capacitance circuit Cv in the frequency-adjusting means 30 with a capacitance element having constant capacitance. Taking for example a case where the structure A has a resonance frequency fst0 of 900 MHz, explanation will be made below. Incidentally, the structure, etc. of the antenna affect the changing level of a resonance frequency, but not its tendency.

In the structure B, the coupling means 20 having a coupling electrode formed on a support made of a dielectric material is opposite to the antenna element 10 with a predetermined gap. Accordingly, the coupling electrode generates coupling capacitance of several pF or less, shifting the resonance frequency toward a lower frequency side (fst0→fst1) by the dielectric material disposed near the antenna element 10. The change of the resonance frequency is about 50-300 MHz, though variable depending on the coupling capacitance. The smaller the coupling capacitance, the smaller the change of the resonance frequency, and vice versa. Incidentally, the series connection of a capacitance element of several pF in place of the variable capacitance circuit Cv between the coupling means 20 and a ground electrode did not change the resonance frequency fst1.

In the structure C, another resonance α occurs by a series circuit constituted by coupling capacitance and the inductance element L2. Affected by the resonance α, the resonance frequency fst2 of the antenna element 10 shifts toward a higher frequency side more than in the structure B. The inductance element L2 is set to have inductance of about several nH to about 50 nH; smaller inductance causes the resonance α to occur at a higher frequency (indicated by "smaller L" in FIG. 5), and larger inductance causes the resonance α to occur at a lower frequency (indicated by "larger L" in FIG. 5). Though only the coupling capacitance is considered here, not only a capacitance element but also an inductance element or a connecting line may be used as the coupling means 20 to obtain the resonance α, because the variable capacitance circuit Cv is connected to the inductance element L2 in series in the present invention.

In the structure D, another resonance βoccurs by a capacitance element and the inductance element L1 connected in parallel to the capacitance element, in addition to the resonance α. Affected by the resonance β, the resonance frequency fst3 of the antenna element 10 shifts toward a lower frequency side more than in the structure C.

In the present invention, the coupling means 20 coupled to the antenna element 10 is grounded via the frequency-adjusting means 30 constituted by a combination of a parallel circuit and a series circuit. With the capacitance of the variable capacitance circuit Cv changed, the resonance frequency of the antenna element is adjusted to a desired frequency by two resonances of the parallel circuit and the series circuit.

Usable as the variable capacitance circuit Cv are a combination of an SPnT (single-pole, n-throw) switch and capacitance elements, a variable capacitance diode (varicap diode, varactor diode), a digital variable capacitance element, MEMS (micro-electromechanical systems), etc. As the SPnT switch, a GaAs switch or a CMOS switch may be used alone, or one or more PIN diodes may be used.

Because semiconductors such as transistors, etc. used as switches for variable capacitance diodes, digital variable capacitance elements, etc., have low power durability with large strain due to the non-linearity of capacitance, they suffer, in handling high-power, high-frequency signals, such problems that harmonic components generated by signal strain are radiated from antenna elements. However, because the variable capacitance circuit Cv is connected to the antenna element 10 via the coupling means 20 in the frequency-variable antenna circuit 1 of the present invention, large-power, high-frequency signals are not supplied to semiconductors, so that signal strain can be suppressed.

Figure 7:
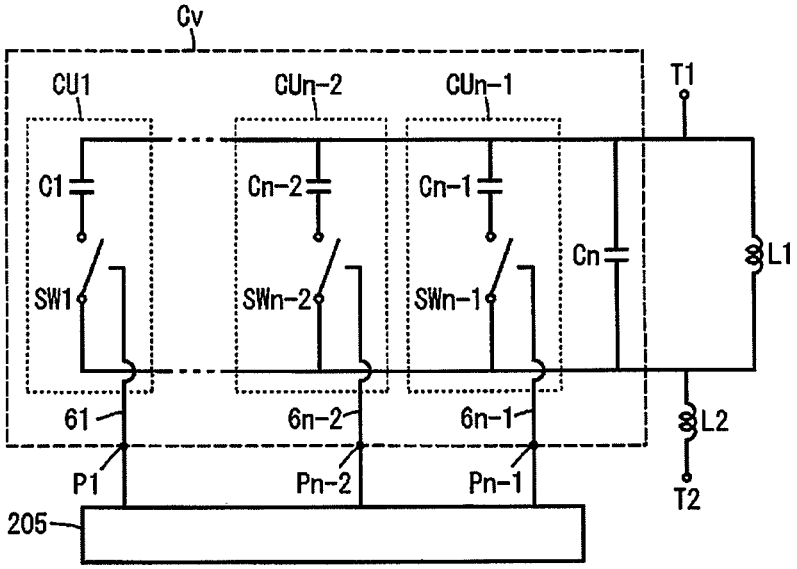
FIG. 7 is a view showing the equivalent circuit of one example of frequency-adjusting means used in the frequency-variable antenna circuit of the present invention.
Figure 8:
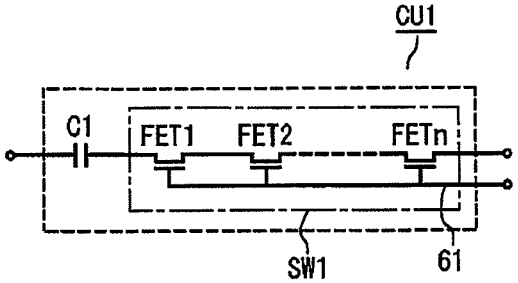
FIG. 8 is a view showing the equivalent circuit of a capacitance unit constituting the frequency-adjusting means of FIG. 7.

Taking for example a case where a digital variable capacitance circuit is used as the variable capacitance circuit Cv, the basic operation of the frequency-adjusting means 30 will be explained in detail below. FIG. 7 shows the equivalent circuit of a frequency-adjusting means comprising a digital variable capacitance circuit. This digital variable capacitance circuit may be the same as described, for example, in JP 2008-166877 A. The variable capacitance circuit Cv comprises capacitance elements C1 to Cn connected in parallel between a terminal T1 and a terminal T2, and switch circuits SW1 to SWn-1 connected in series between the terminal T2 and the capacitance elements C1 to Cn-1, each capacitance element C1 to Cn-1 and each switch circuit SW1 to SWn-1 constituting a capacitance unit CU1 to CUn-1. Each switch circuit SW1 to SWn-1 may be constituted by MOS-FET. FIG. 8 shows one example of capacitance units. Each capacitance unit CU1 to CUn-1 is a series circuit of a capacitance element and cascade-connected MOS-FETs each having a drain and a source. Because higher power durability is obtained when FETs are disposed on a closer side to a ground electrode GND, connection is made in the variable capacitance circuit Cv in the depicted example such that the terminal T1 is positioned on the side of the coupling means 20, while the terminal T2 is positioned on the side of the ground electrode GND, though the connection may be reversed.

In each capacitor unit CU1 to CUn-1, voltage is applied to gate terminals of cascade-connected FETs through common signal lines 61 to 6*n*-1, and data bits for controlling the ON/OFF of FETs are supplied from a control circuit 205 to an input port P1-Pn-1 of each common signal line 61 to 6*n*-1.

The capacitance element Cn and the capacitance units CU1 to CUn-1 are connected in parallel between the terminal T1 and the terminal T2, and the capacitance elements C1 to Cn-1 preferably constitute a binary-weighted capacitor array providing data bits corresponding to the capacitance units CU1 to CUn-1. For example, when the capacitance units correspond to bits from the lowest bit to the highest bit in the order from CU1 to CUn-1, a capacitance element C1 in a capacitance unit CU1 has capacitance of e pF, a capacitance element C2 in a capacitance unit CU2 has capacitance of $2^1$×e pF, a capacitance element C3 in a capacitance unit CU3 has capacitance of $2^2$×e pF, a capacitance element Cn-2 in a capacitance unit CUn-2 has capacitance of $2^{n-3}$×e pF, and a capacitance element Cn-1 in a capacitance unit CUn-1 has capacitance of $2^{n-2}$×e pF. For example, when n=6, the capacitance of the entire variable capacitance circuit Cv is the capacitance of the capacitance element C6 at the data bit of "00000" for controlling the ON/OFF of FETs, and a combined capacitance of the capacitance element C6 and the capacitance elements C1-C5 at the data bit of "11111." Because a capacitance-adjusting resolution has 5 bits in this example, the capacitance can be adjusted in 32 steps (states).

The capacitance (combined capacitance) C of the variable capacitance circuit Cv linearly changes from Cmin corresponding to a bit sequence of "00000" to Cmax corresponding to a bit sequence of "11111." For example, when the resonance frequency is variable in a fundamental frequency band, the circuit constants of the frequency-variable antenna circuit, such as inductance elements L1, L2, etc. are set to have resonance at a frequency f1 substantially corresponding to a center frequency of a fundamental frequency band substantially at capacitance of (Cmax−Cmin)/2, which is a center of the variable capacitance range. Of course, the number of steps and variable range of capacitance, and the changing range of the resonance frequency differ depending on the number of bits.

Figure 9:
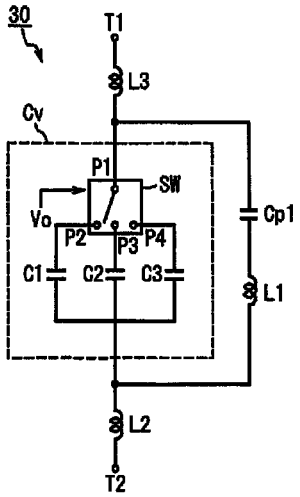
FIG. 9 is a view showing the equivalent circuit of another example of frequency-adjusting means used in the frequency-variable antenna circuit of the present invention.
Figure 10:
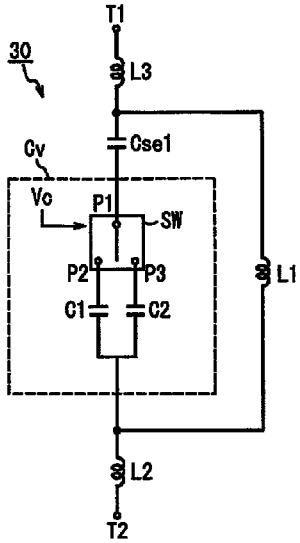
FIG. 10 is a view showing the equivalent circuit of a further example of frequency-adjusting means used in the frequency-variable antenna circuit of the present invention.

FIGS. 9 and 10 show one example of frequency-adjusting means comprising a variable capacitance circuit Cv constituted by an SPnT (single-pole, n-throw) switch and capacitance elements. An SP3T switch is used in FIG. 9, and an SP2T switch is used in FIG. 10. With a common port P1 of the switch on the side of the terminal T1 (on the side of the coupling electrode 20), and ports P2, P3, P4 on the side of the terminal T2 (on the side of the ground), each of capacitance elements C1, C2, C3 with different capacitances is connected in series to each of the ports P2, P3, P4. With connection paths changed by switching, pertinent capacitance is selected to change the resonance frequency.

A series circuit of an inductance element L1 and a capacitance element Cp1 is connected in parallel to the variable capacitance circuit Cv shown in FIG. 9, and an inductance element L3 is connected in series to the parallel circuit on the side of the terminal T1. In the variable capacitance circuit Cv shown in FIG. 10, an inductance element L3 and a capacitance element Cse1 are connected in series to the parallel circuit on the side of the terminal T1, and an inductance element L1 is connected in parallel to a connecting point of the inductance element L3 and the capacitance element Cse1. The capacitance elements Cp1, Cse1 are DC-cutting capacitors, stabilizing the switching operation. The inductance element L3 is added to finely adjust the inductance. When a connection direction to the switch circuit SW is reversed (to put the switch circuit SW on the side of the terminal T2, and the capacitance element on the side of the terminal T1) in the variable capacitance circuits Cv shown in FIGS. 9 and 10, the same variable capacitance function are obtained, and the DC-cutting capacitors Cp1, Cse1 are not needed.

Figure 11:
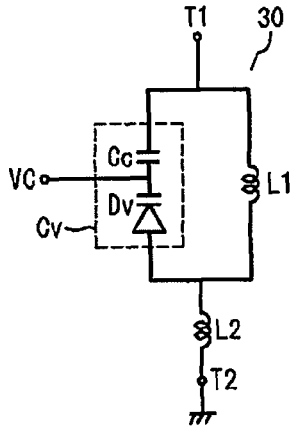
FIG. 11 is a view showing the equivalent circuit of a still further example of frequency-adjusting means used in the frequency-variable antenna circuit of the present invention.

FIG. 11 shows one example of variable capacitance circuits Cv, which comprises a variable capacitance diode. The cathode of the variable capacitance diode Dv is connected to the terminal T1 via a DC-cutting capacitor Cc. When reverse bias voltage is applied to the variable capacitance diode Dv, the width of a depletion layer in the diode Dv changes, resulting in continuously changed electrostatic capacitance. With higher reverse voltage applied to the cathode of the variable capacitance diode Dv, the electrostatic capacitance decreases. Thus, the resonance frequency changes depending on voltage applied to the variable capacitance diode. When the variable capacitance diode is used, a bias-applying circuit for arbitrarily changing the reverse bias voltage is needed.

When voltage with large amplitude is input to the variable capacitance diode Dv, bias is also applied in a forward direction depending on the voltage amplitude, resulting in the likelihood that a forward operation is carried out when a reverse operation should be carried out, with little change of capacitance if any. To cope with this problem, another variable capacitance diode may be added with its cathode connected to a common terminal, to prevent control voltage with large amplitude from being applied in a forward direction.

Figure 12:
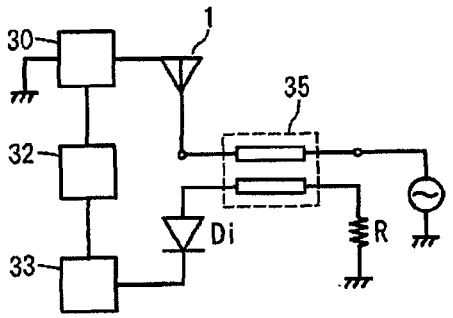
FIG. 12 is a block diagram showing one example of tuning circuits using the frequency-variable antenna circuit of the present invention.

The resonance frequency of the antenna element is likely to change under the influence of disturbance such as a human body, etc. The deviation of the resonance frequency results in the change of an impedance-matching state, but the frequency-variable antenna circuit of the present invention can easily adjust the resonance frequency of the antenna element. FIG. 12 shows one example of feedback circuits, which comprises the frequency-variable antenna circuit. The feedback circuit comprises a directional coupler 35 for detecting the reflected waves of transmitting signals, a detection circuit Di, a signal level detector 33 for detecting a signal level by the comparison of an external reference signal with a detection signal from the detection circuit Di, and a control circuit 32 for changing the capacitance of the variable capacitance circuit based on detection results to eliminate the deviation of the resonance frequency when the reflected waves become large. Incidentally, a coupling means, etc. are not shown. This feedback circuit conducts a feedback control based on the intensity change of received signals.

Figure 13:
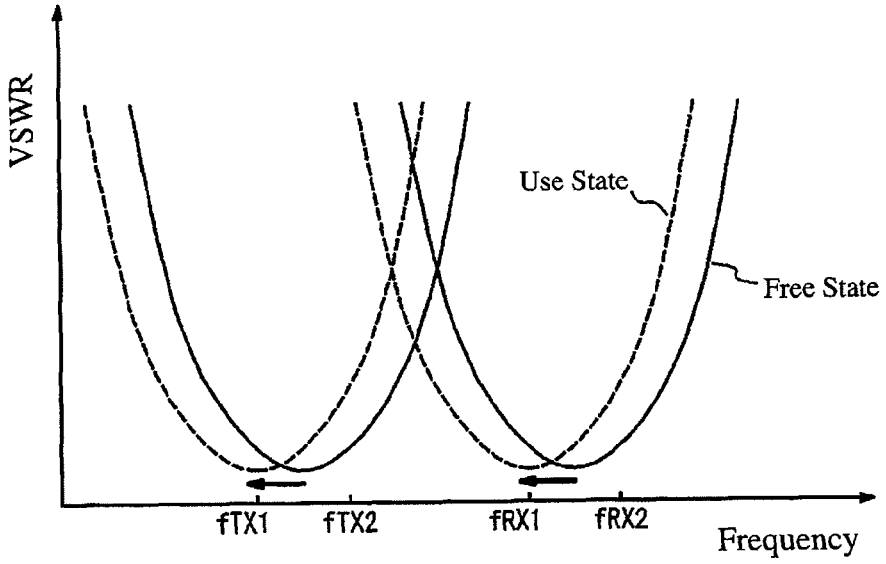
FIG. 13 is a graph showing the difference of VSWR characteristics between a use state and a free state.

An example in which a frequency-variable antenna circuit comprising a digital variable capacitance circuit is used in a wireless communications apparatus having a transmission frequency band of 824-849 MHz and a receiving frequency band of 869-894 MHz are explained in detail below. Because a human body may be regarded as a dielectric material having a low dielectric constant, the resonance frequency of the antenna element in use (close to a human body) is lower than that in a free state (not affected by a human body). FIG. 13 shows VSWR characteristics both in a free state and in a practically used state. The variable capacitance circuit of the frequency-adjusting means 30 is programmed to have combined capacitance, with which optimum VSWR is achieved in a transmission frequency band (for example, having a center frequency of 836.5 MHz) and a receiving frequency band (for example, having a center frequency of 881.5 MHz) in a free state. As long as the deviation of a frequency due to disturbance is relatively small, VSWR under the predetermined level can be kept in both transmission and receiving frequency bands.

The influence of a human body on the VSWR characteristics appears as the deviation of the resonance frequency as large as about 10-30 MHz. Because this deviation of the resonance frequency does not largely differ between the transmission frequency band and the receiving frequency band, control results in any one of the transmission frequency band and the receiving frequency band can be used for control in the other frequency band.

When reflected waves determined from the detected signal level exceed a predetermined threshold in a predetermined period of time, the resonance frequency is feedback-controlled. To have larger or smaller combined capacitance, the digital variable capacitance circuit is changed by one step (state) by the control circuit. When the reflected waves largely differ from the threshold, change may be made by two or more steps. A newly detected signal level is compared with an immediately previously detected signal level (stored, for example, in a memory, etc.), to determine whether the reflected waves have increased or decreased, so that the combined capacitance of the digital variable capacitance circuit is increased or decreased depending on its result.

The feedback control is continued until the reflected waves become smaller than the threshold, and terminated when the reflected waves have become smaller than the threshold. When the reflected waves do not become smaller than the threshold or oppositely increase, the feedback control is terminated, and the digital variable capacitance circuit is controlled based on the detected signal level to a step (state) providing the smallest reflected waves.

[2] Antenna Device

Figure 14:
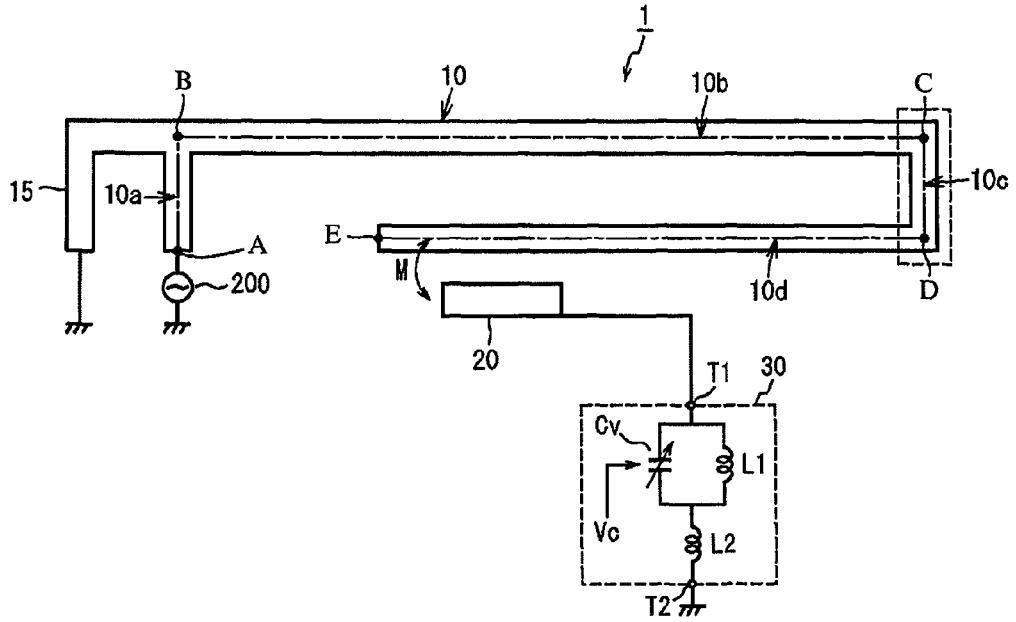
FIG. 14 is a view showing another example of the frequency-variable antenna circuits of the present invention.

The antenna element 10 shown in FIG. 3 has a line extending horizontally to the ground electrode GND, but it is preferably made smaller with a turned portion as shown in FIG. 14. Pluralities of turned portions may be added. The antenna element 10 shown in FIG. 14 comprises a region 10*a* between a feeding point A and a bending point B, a region 10*b* between the bending point B and a bending point C, a region 10*c* between the bending point C and a bending point D, and a region 10*d* between the bending point D and an open end E, the region 10*c* being a turned portion, and the region 10*d* extending in an opposite direction to the region 10*b*. Because the length from the feeding point A to the open end E substantially corresponds to a resonance frequency f1*r* in a low-frequency band as in the antenna element 10 shown in FIG. 3, the antenna element 10 shown in FIG. 14 is operated in a series resonance mode. The antenna element 10 having a turned portion is shorter than that shown in FIG. 3 because of a complicated resonance current distribution. Also, a multi-resonant antenna operable in a series resonance mode is obtained by setting the length from the feeding point A to the bending point C substantially equal to about ¼ of a wavelength λ2 corresponding to a resonance frequency in a high-frequency band, easily providing a multi-band antenna.

Figure 15:
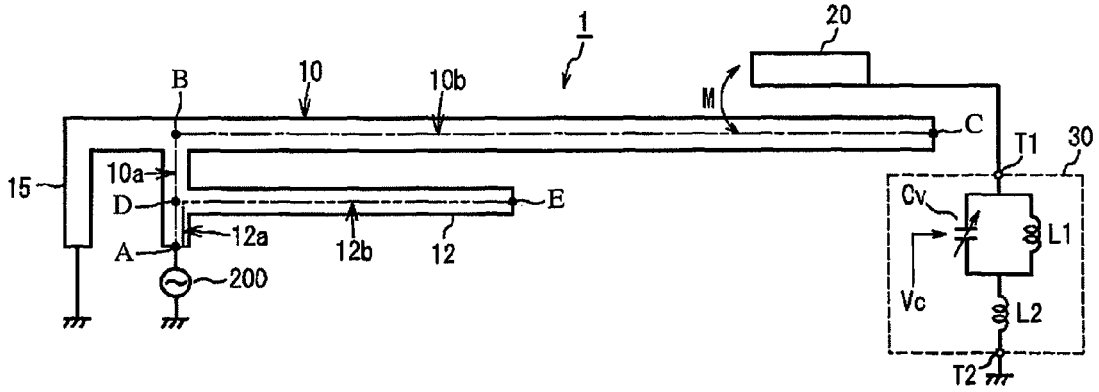
FIG. 15 is a view showing a further example of the frequency-variable antenna circuits of the present invention.

As shown in FIG. 15, the antenna element 10 may have an antenna element 12 extending from a branching point D in the region 10*a* between the feeding point A and the bending point B. The antenna element 12 is constituted by a region 12*a* between the feeding point A and the branching point D, and a region 12*b* between the branching point D and an open end E. The region 12*a* of the antenna element 12 is common to part of the region 10*a* of the antenna element 10, and the region 12*b* extends in parallel with the region 10*b* of the antenna element 10 in the same direction. When the antenna element 10 has a resonance frequency in a low-frequency band, and when the antenna element 12 has a resonance frequency in a high-frequency band, a multi-resonant antenna is obtained.

The antenna element 10 can be formed by a known method such as an etching method, a photolithography method, etc. on a so-called printed board having a rigid board such as a glass-fiber-reinforced epoxy resin board, etc., or a flexible board made of polyimides such as polyimide, polyetherimide and polyamideimide, polyamides such as nylons, polyesters such as polyethylene terephthalate, etc. Also, using a known method such as a printing method, an etching method, etc., the antenna element 10 may be produced by forming a low-resistance conductor such as Au, Ag, Cu, etc. on a board made of dielectric ceramics such as alumina. A antenna element formed on a deformable flexible board can be efficiently disposed in a limited space within a casing.

Figure 16:
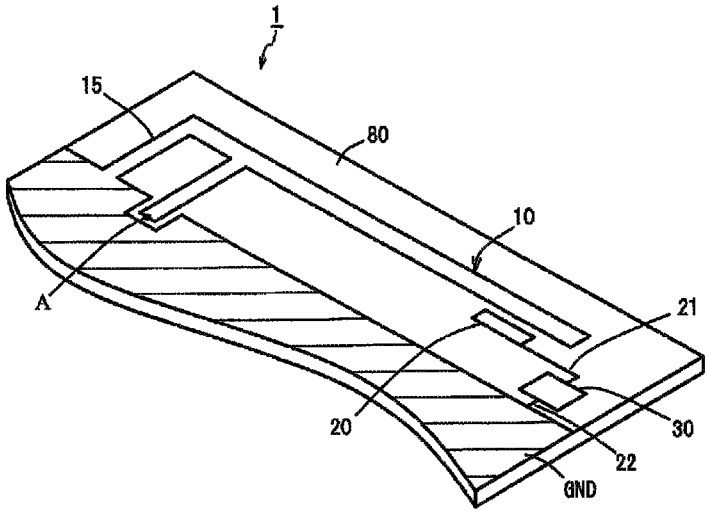
FIG. 16 is a perspective view showing one example of the antenna devices of the present invention.

FIG. 16 shows an example in which an antenna element and a coupling means are formed on a board. For example, a copper foil on a glass-fiber-reinforced epoxy resin board is etched to form electrode patterns for an antenna element 10 and a coupling means 20, a ground electrode GND, connecting lines 21, 22, etc. A rear surface of the board is not provided with a ground electrode GND. This method can easily form each electrode pattern with high precision, providing an antenna device not affected by influence such as an external force. The mere addition of a device constituting the frequency-adjusting means 30 would easily provide a frequency-variable antenna circuit.

The antenna element may be formed by a thin conductor plate of Cu or phosphor bronze. Because a thin conductor plate is easily worked and resistant to deformation by an external force, it can form an antenna element with an unlimited shape regardless of a support. The integral injection molding of an engineering plastic such as a liquid crystal polymer with a thin conductor plate provides an antenna device more resistant to deformation by an external force.

Figure 17:
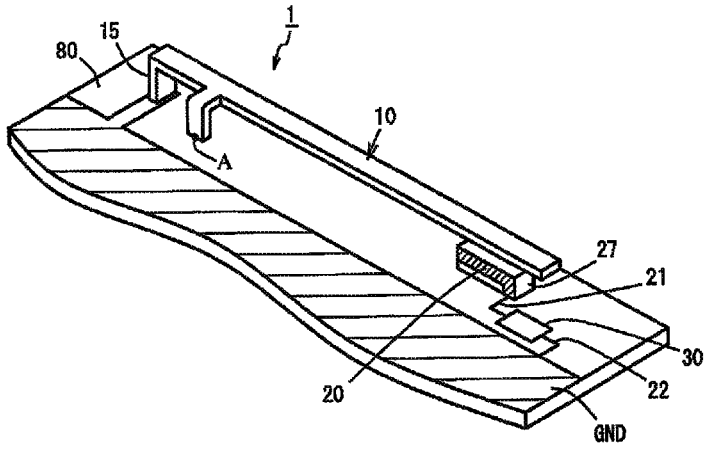
FIG. 17 is a perspective view showing another example of the antenna devices of the present invention.

FIG. 17 shows an example in which an antenna element formed by a thin conductor plate of phosphor bronze, etc. is vertically mounted on a glass-fiber-reinforced epoxy resin board provided on the surface with a ground electrode GND, connecting lines 21, 22, etc. formed by a copper foil. An open end of the antenna element 10 is fixed to a dielectric chip support 27 disposed on the board. The support 27 is provided on the surface with an L-shaped electrode pattern acting as a coupling means 20 electromagnetically coupled to the antenna element 10. The coupling means 20 is connected to a ground electrode GND via the connecting lines 21, 22 and a frequency-adjusting means 30 formed on the board. Generally, a higher radiation gain is obtained as the antenna element gets distant from the ground electrode. Accordingly, a high antenna element 10 enables the antenna device to be constituted three-dimensionally with enough gap between the antenna element and the ground electrode in a small area.

Figure 18:
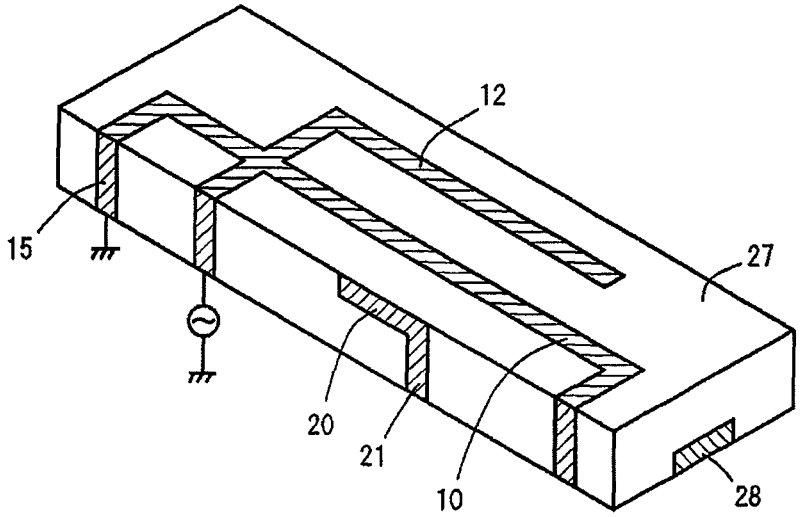
FIG. 18 is a perspective view showing a further example of the antenna devices of the present invention.

As shown in FIG. 18, a first antenna element 10 and a second antenna element 12 shorter than the first antenna element 10 may be formed on a large dielectric chip 27 together with a coupling means 20 and a connecting line 21.

Figure 19:
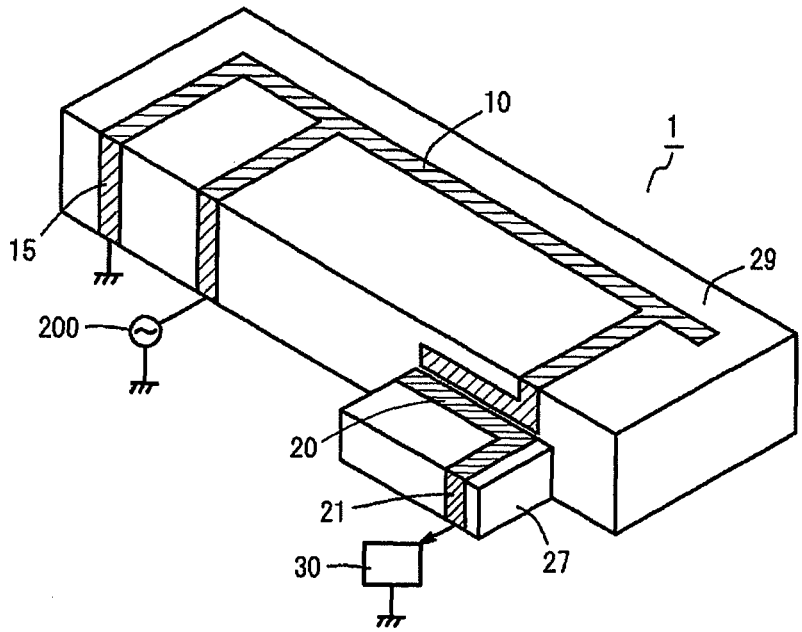
FIG. 19 is a perspective view showing a still further example of the antenna devices of the present invention.
Figure 20:
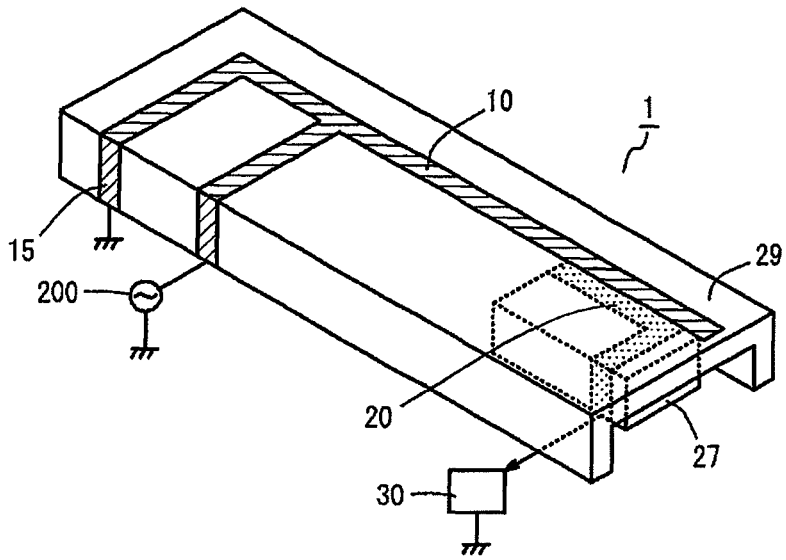
FIG. 20 is a perspective view showing a still further example of the antenna devices of the present invention.

FIGS. 19 and 20 show another example of antenna devices, in which a coupling means 20 formed on an additional support 29 is disposed near an antenna element 10. In the antenna device shown in FIG. 20, the coupling means 20 is disposed in a recess of a support 29 having a U-shaped cross section. Materials for the support 29 may be polycarbonates, etc.

Alternatively, an antenna element and other elements may be formed on different boards, or an antenna element formed on a ceramic substrate may be mounted on a printed board. Also, part of the antenna element 10 may be formed by a thin conductor plate of phosphor bronze, etc., and the other part of the antenna element 10 may be formed by an electrode pattern on a printed board. Further, to adjust electromagnetic coupling to the coupling means 20, a portion of the antenna element 10 opposing the coupling means 20 may have a different shape (width and thickness) from that of the other portion. To have a sufficient variable frequency range with the optimum coupling of the antenna element 10 to the coupling means 20, materials for the support, the shape and size of the coupling means 20, a gap between the coupling means 20 and the antenna element 10, etc. are adjusted.

As described above, the coupling means 20 may be formed directly on a board together with the antenna element 10, or formed on a support, which is then mounted on a board. Though a coupling means 20 formed by a thin, rigid conductor (metal) plate may be combined with an antenna element 10, the coupling means 20 is preferably formed on a support 27, because it is difficult to dispose the coupling means 20 on the board with a highly precise gap to the antenna element 10. Because the coupling means 20 formed on the support 27 is not deformed by an external force, a gap between the coupling means 20 and the antenna element 10 does not change, and it is easy to position the coupling means 20 with a predetermined gap to the antenna element 10. The support 27 for the coupling means 20 disposed near the antenna element 10 exhibits a wavelength-reducing effect, making the line length of the antenna element 10 shorter.

The coupling means 20 is preferably constituted by an electrode pattern formed on a surface of the support 27. Materials for the electrode pattern are preferably Cu, Ag, Au, or alloys thereof. The support 27 is preferably made of dielectric ceramics such as alumina, Al—Si—Sr ceramics, Mg—Ca—Ti ceramics, Ca—Si—Bi ceramics, etc., or soft-magnetic ceramics such as Ni—Zn ferrite, Ni—Cu—Zn ferrite, etc. Glass-fiber-reinforced epoxy resins may also be used. For use in a high-frequency band, the support 27 preferably has excellent high-frequency characteristics. Dielectric ceramics preferably have excellent high-frequency dielectric characteristics (for example, small dielectric loss, etc.). Too large a dielectric constant leads to large dielectric loss, while too small a dielectric constant fails to obtain a sufficient wavelength-shortening effect. Accordingly, Dielectric materials for the support 27 preferably have dielectric constants of 5-30. The temperature characteristics of materials for the support 27 may be determined depending on the characteristics of reactance elements used for the resonance circuits.

FIGS. 21-24 show examples of coupling means 20 each formed on a support 27. A connecting electrode pattern 42 soldered to the antenna element 10 is formed on each support 27. The electrode pattern 42 electrically connected to the antenna element 10 may function as an extension electrode.

The coupling of the coupling means 20 to the antenna element 10 is determined by a gap between the electrode pattern 42 formed on the support 27 and the coupling means 20. The electrode pattern 42 is not needed when the support 27 is bonded to the antenna element 10, but the positioning of the support 27 to the antenna element 10 is difficult. Of course, as a terminal electrode mounted on a board, the electrode pattern 42 may be formed on a lower surface of the support 27.

Figure 21:
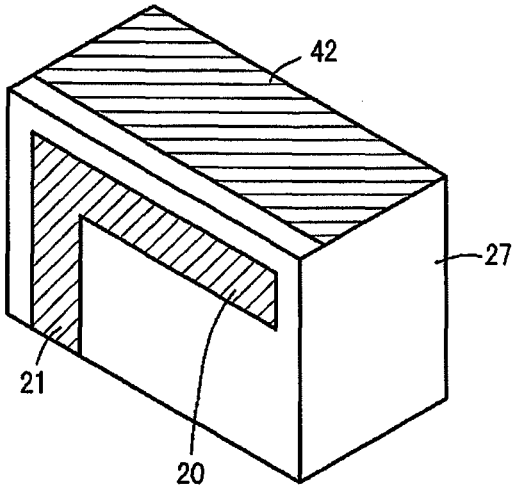
FIG. 21 is a perspective view showing one example of coupling means used in the antenna device of the present invention.
Figure 22:
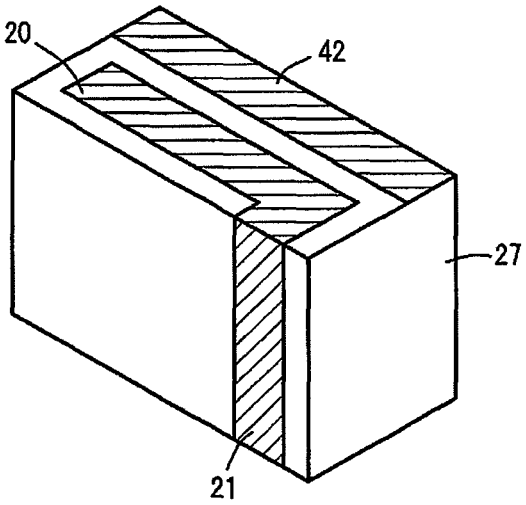
FIG. 22 is a perspective view showing another example of coupling means used in the antenna device of the present invention.
Figure 23:
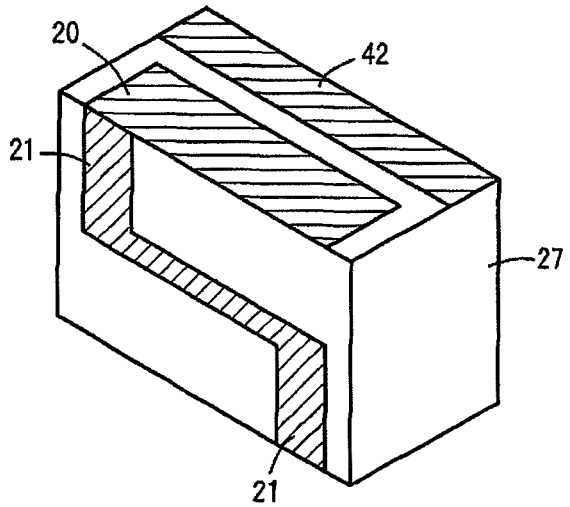
FIG. 23 is a perspective view showing a further example of coupling means used in the antenna device of the present invention.
Figure 24:
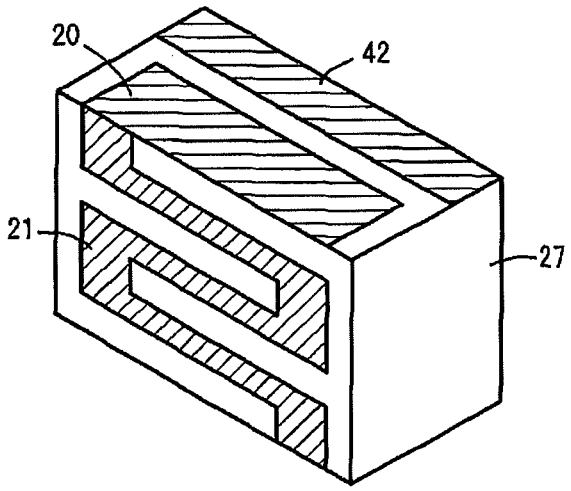
FIG. 24 is a perspective view showing a still further example of coupling means used in the antenna device of the present invention.

In the example shown in FIG. 21, a strip-shaped electrode pattern constituting the coupling means 20 is formed on a side surface of the support 27, and a connecting line 21 is constituted by an electrode pattern integral with the electrode pattern of the coupling means 20 on the same side surface, resulting in an L-shaped electrode pattern. In the examples shown in FIGS. 22-24, strip-shaped electrode patterns constituting a coupling means 20 and an electrode pattern 42 are formed on an upper surface of a support 27, and connected to a connecting line 21 formed on a side surface. The connecting line 21 may be straight, L-shaped as shown in FIG. 23 or meandering as shown in FIG. 24. The connecting line 21 preferably has a line portion substantially in parallel to the electrode pattern of the coupling means 20, because it improves an average gain in a fundamental frequency band. The depicted electrode pattern of the coupling means 20 is a strip electrode having a constant width, though not restrictive. The electrode pattern may have a proper shape such as a tapered shape depending on desired electromagnetic coupling.

A longer distance between the coupling means 20 and a ground electrode may provide the resonance frequency of the antenna element 10 with an extremely narrower variable range by changing the capacitance of the frequency-adjusting means 30. Accordingly, the frequency-adjusting means 30 is preferably disposed near the antenna element 10 and grounded with a short distance (for example, ¼ or less of the wavelength of a frequency band to be adjusted).

[3] Wireless Communications Apparatus

Figure 25:
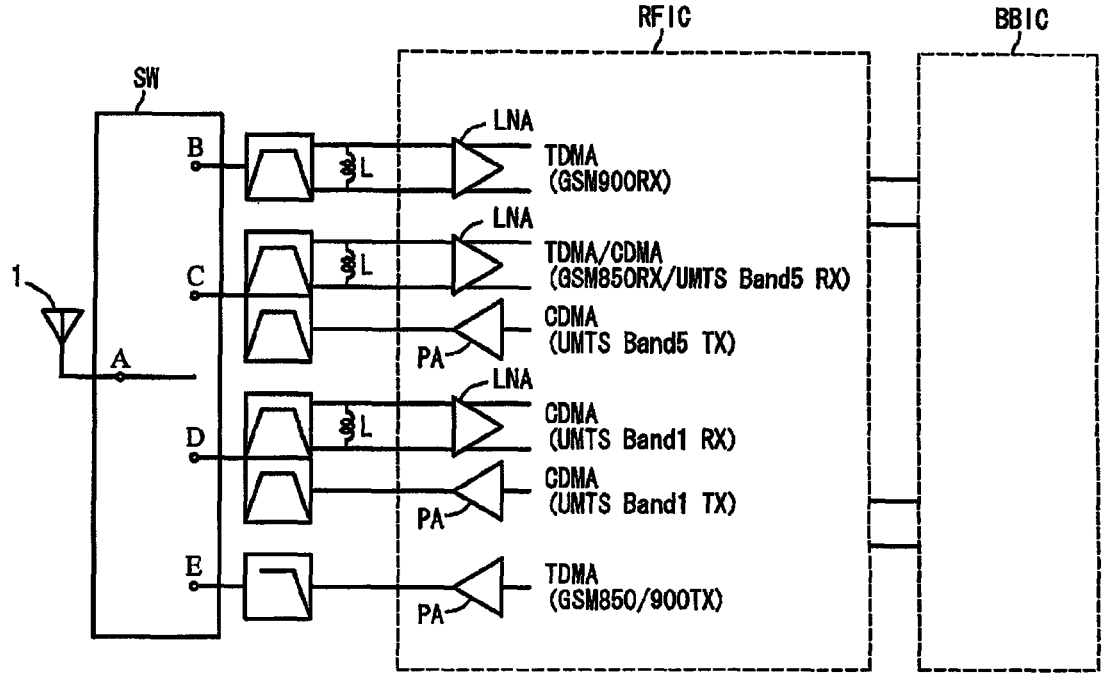
FIG. 25 is a block diagram showing an example of the circuits of wireless communications apparatuses using the frequency-variable antenna circuit of the present invention.
Figure 29:
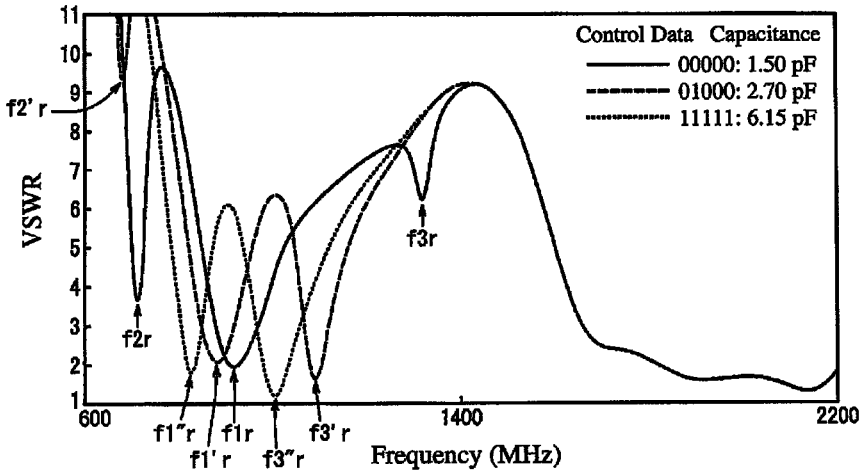
FIG. 29 is a graph showing the VSWR characteristics of the antenna device of the present invention.

FIG. 25 shows one example of circuits for a wireless communications apparatus comprising the frequency-variable antenna circuit (antenna device) 1 of the present invention for pluralities of communications systems. The frequency-variable antenna circuit 1 exhibits desired VSWR characteristics in low- and high-frequency bands as shown in FIG. 29, with a resonance frequency variable in a low-frequency band. Among pluralities of communications systems, for example, GSM (registered trademark) 850/900, etc. can be used in a low-frequency band, and DCS, PCS, UMTS, etc. can be used in a high-frequency band.

The depicted wireless communications apparatus is usable in four communications systems comprising GSM (registered trademark) 850/900 bands (824-960 MHz) and UMTS bands (Band 1: 1920-2170 MHz, Band 5: 824-894 MHz). In this example, the frequency-variable antenna circuit 1 is connected to a single-pole, quadruple-throw switch circuit SW. The switch circuit SW is, for example, an electric switch mainly comprising FET switches for changing a connection state by control voltage applied to gates. The switch circuit SW is disposed between the frequency-variable antenna circuit 1 and a high-frequency amplifier PA and a low-noise amplifier LNA as transmitting/receiving front ends for a first communications system (UMTS Band 5) of CDMA, a high-frequency amplifier PA and a low-noise amplifier LNA as transmitting/receiving front ends for a second communications system (UMTS Band 1) of CDMA, a high-frequency amplifier PA and a low-noise amplifier LNA as transmitting/receiving front ends for a first communications system (GSM900) of TDMA, and a high-frequency amplifier PA and a low-noise amplifier LNA as transmitting/receiving front ends for a second communications system (GSM850) of TDMA, to conduct the switching of transmitting and receiving signals in each communications system.

Among the high-frequency amplifiers PA and the low-noise amplifiers LNA, at least low-noise amplifiers LNA are contained in a radio-frequency integrated circuit (RFIC). RFIC is an IC converting signals from a baseband IC (BBIC) to a transmission frequency together with a frequency synthesizer (not shown), etc., and received signals to a frequency that can be treated by the baseband IC (BBIC). In the depicted structure, a low-noise amplifier LNA is commonly used for the first communications system (UMTS Band 5) of CDMA and the second communications system (GSM850) of TDMA.

Disposed in each signal path are filters such as a lowpass filter, a bandpass filter, etc., and a duplexer comprising filters having different passbands connected in parallel. In this example, unbalanced-input, balanced-output SAW filters, BAW filters or BPAW filters are used as bandpass filters and duplexers, and impedance-adjusting inductance elements L are disposed between balanced-output terminals. As another matching structure, a capacitance element may be disposed between balanced-output terminals, or a reactance element may be disposed between each balanced-output terminal and a ground.

The wireless communications apparatus generates signals of local oscillation frequencies by a frequency synthesizer based on a control signal from a central processing circuit in a logic circuit (not shown), to conduct transmitting and receiving in frequencies determined thereby. The variable capacitance circuit in the frequency-variable antenna circuit 1 is controlled by the control signal from the control circuit 32 shown in FIG. 12, to obtain proper VSWR in transmission and receiving frequency bands in the low-frequency band of each communications system.

The present invention will be explained in more detail referring to Examples below without intention of restriction.

EXAMPLE 1

Figure 26:
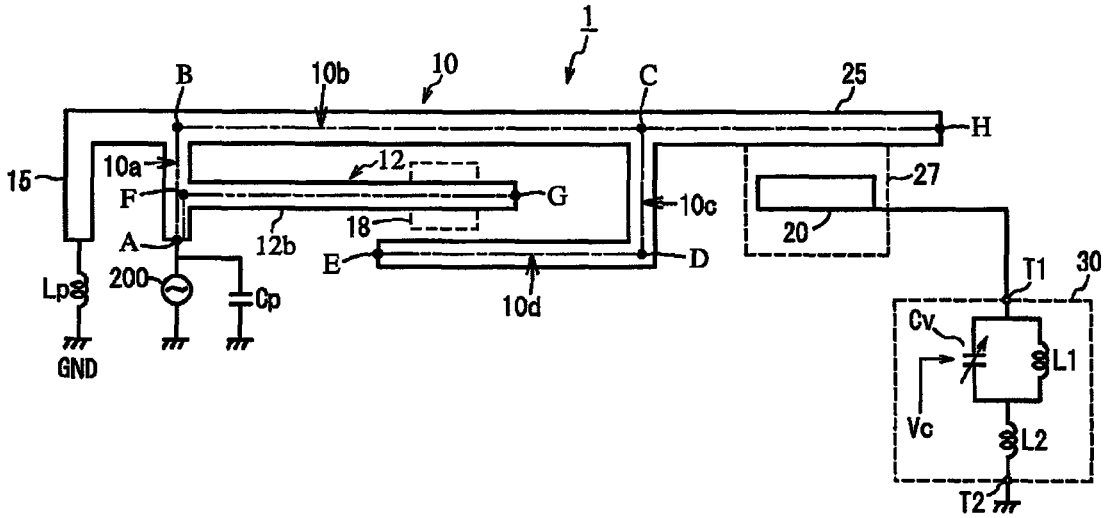
FIG. 26 is a view showing a still further example of the frequency-variable antenna circuits of the present invention.
Figure 27:
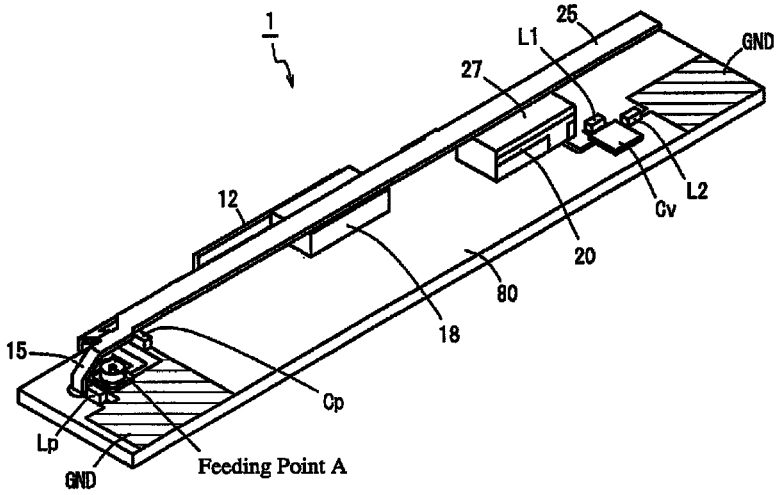
FIG. 27 is a perspective view showing a still further example of the antenna devices of the present invention.
Figure 28:
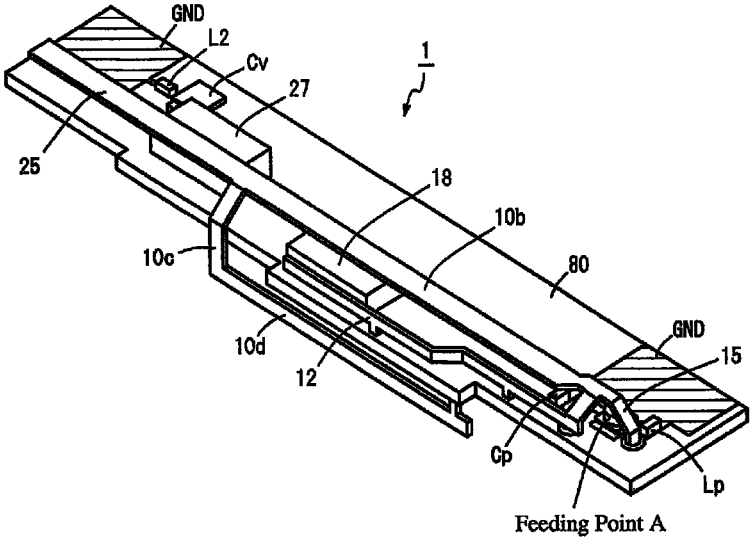
FIG. 28 is a perspective view showing a still further example of the antenna devices of the present invention.

FIG. 26 shows one example of the frequency-variable antenna devices of the present invention capable of handling a low-frequency band and a high-frequency band, and FIGS. 27 and 28 show its appearance. In the figures, a power supply path to a variable capacitance circuit Cv in a frequency-adjusting means 30 is omitted.

The frequency-variable antenna circuit 1 is formed on an antenna board 80 separate from a main circuit board (not shown) on which a feeding circuit 200 is formed, and the antenna board 80 is connected to the main circuit board by a coaxial cable. Other connection methods include, for example, connection by pushing a grounded plate spring terminal on the main circuit board to the antenna board (called "C-clip"). In this case, a connecting portion of the antenna board comprises only a connecting electrode terminal The antenna element 10 formed by a thin conductor plate made of Cu comprises a first antenna element 10 (comprising regions 10*a*, 10*b*, 10*c* and 10*d*) for a low-frequency band, an auxiliary line 25 branching from the first antenna element 10, and a second antenna element 12 for a high-frequency band, which is shorter than the first antenna element 10 and partially opposing the first antenna element 10. The auxiliary line 25 branching from the first antenna element 10 acts with the first antenna element 10 to input and radiate high-frequency signals in a low-frequency band. Accordingly, the auxiliary line 25 may be regarded as part of the first antenna element 10.

The entire antenna element is constituted by an integral strip conductor of 0.2 mm in thickness and 1-1.5 mm in width, which is bent at several points, with first and second antenna elements 10 and 12 constituting an inverted-F antenna resonating in frequencies in a low-frequency band and a high-frequency band. The antenna element is vertically mounted on both surfaces of an antenna board (a glass-fiber-reinforced epoxy resin board with copper layers on both surfaces) 80. Part of the first antenna element 10, the second antenna element 12 and the auxiliary line 25 are positioned on a first main surface of the antenna board 80, the first antenna element 10 being bent such that its region 10*c* extends to a second main surface on the opposite side, and that its region 10*d* extends from the region 10*c* in parallel to the region 10*b* reversely toward the feeding point A.

The first antenna element 10 has pluralities of regions, a region 10*d* on the second main surface being opposing a region 12*b* of the second antenna element 12 on the first main surface via the antenna board 80. Disposed under part of the region 12*b* of the second antenna element 12 is a dielectric chip 18 having an electrode pattern formed on the surface. Because the dielectric chip 18 extends to the vicinity of the regions 10*b* and 10*d*, there is stronger electromagnetic coupling between the region 10*b* and the region 12*b* and between the region 10*d* and the region 12*b* than between other portions. Also, because an electrode pattern formed on the dielectric chip 18 is connected to the second antenna element 12, the second antenna element 12 may be shorter because of the wavelength-reducing effect. By adjusting the length of the region 10*b* of the first antenna element 10 extending in parallel with the region 12*b* of the second antenna element 12 depending on the wavelength of a resonance frequency in a high-frequency band, a bandwidth for obtaining the desired VSWR in a high-frequency band can be expanded.

Mounted on the antenna board 80 are, in addition to the antenna element, a support 27 on which a coupling means 20 electromagnetic coupled to the auxiliary line 25 is formed, a digital variable capacitance circuit element Cv constituting a frequency-adjusting means 30 connected to the coupling means 20, first and second inductance elements L1, L2, a dielectric chip 18 for adjusting the electromagnetic coupling of the first antenna element 10 to the second antenna element 12, and an inductance element Lp and a capacitance element Cp for matching. Of course, at least part of the inductance element Lp and the capacitance element Cp for matching and the frequency-adjusting means 30 disposed on the same plane of the antenna board 80 may be formed on a rear surface of the antenna board 80.

In this example, the coupling means 20 is constituted by an electrode pattern of Ag formed on the dielectric ceramic support 27. An electrode pattern soldered to the auxiliary line 25 is also formed on the support 27. The antenna element has pluralities of electrode extensions, with which the antenna element is fixed to the antenna board 80, and an auxiliary line 25 by which the antenna element is connected to the electrode pattern on an upper surface of the support 27. Electromagnetic waves are not radiated from the electrode extensions toward the antenna board 80. The dielectric chip 18 and the support 27 were made of a dielectric ceramic having a dielectric constant of 10.

In this example, the first antenna element 10 had a region 10*b* of about 25 mm in length and an auxiliary line 25 of about 15 mm in length on the first main surface, and a region 10*d* of about 20 mm in length on the second main surface, and the second antenna element 12 had a region 12*b* of about 20 mm in length. With this structure, the antenna device was received in a planar size of 45 mm×8 mm determined by the antenna board 80, with a thickness of 5 mm or less.

Because the digital variable capacitance circuit element Cv had a first capacitance element C6 (1.50 pF), and capacitance elements C1 (0.15 pF), C2 (0.30 pF), C3 (0.60 pF), C4 (1.20 pF), C5 (2.40 pF) in capacitance units CU1 to CU5, the variable capacitance range was 1.50-6.15 pF. The first inductance element L1 had inductance of 15 nH, the second inductance element L2 had inductance of 18 nH, the matching inductance element Lp had inductance of 3.9 nH, and the matching capacitance element Cp had capacitance of 1 pF.

With respect to this antenna device, the frequency characteristics of VSWR were evaluated with a resonance frequency f1*r* in a low-frequency band changed by the frequency-adjusting means 30. Table 1 shows the change of resonance frequency when the control data were changed. In the table, "–" indicates that the resonance frequency was lower than a measurement frequency. FIG. 29 shows VSWR characteristics by which the resonance frequency of the antenna changed depending on the control data supplied to the digital variable capacitance circuit element Cv. The control data shown in FIG. 29 were "00000," "01000," and "11111."

TABLE 1

| Control Data | Capacitance (pF) | Resonance Frequency f1r (MHz) | Frequency Bandwidth(1) | Resonance Frequency f2r (MHz) | Resonance Frequency f3r (MHz) |
|---|---|---|---|---|---|
| 00000 | 1.50 | 920 | 84 | 713 | 1320 |
| 00100 | 2.10 | 899 | 72 | 697 | 1164 |
| 01000 | 2.70 | 881 | 62 | 683 | 1089 |
| 01101 | 3.45 | 862 | 53 | 668 | 1046 |
| 10010 | 4.20 | 848 | 49 | — | 1025 |
| 11111 | 6.15 | 827 | 44 | — | 1003 |

Note:
(1)A frequency range in which VSWR was 3 or less.

As is clear from Table 1 and FIG. 29, with the control data changing from "00000" to "11111," the resonance frequency of the antenna shifted in a low-frequency band while keeping VSWR of 3 or less. This example provides a multi-band antenna having a resonance frequency widely changeable for handling a wide frequency band.

EXAMPLE 2

Figure 30:
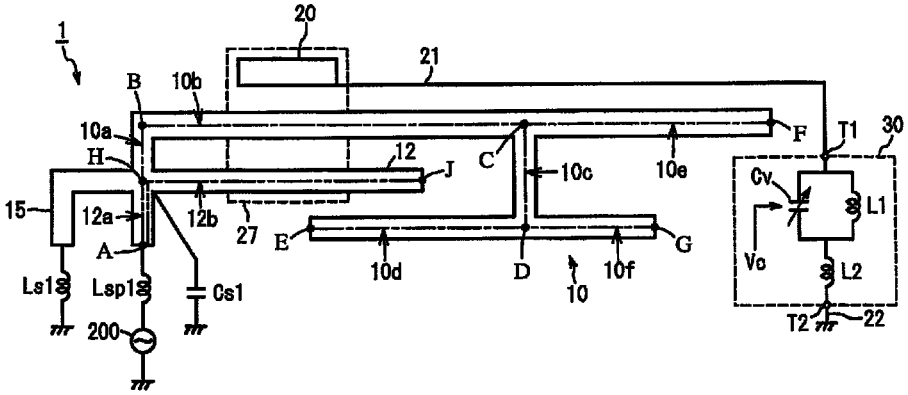
FIG. 30 is a view showing a still further example of the frequency-variable antenna circuits of the present invention.
Figure 31:
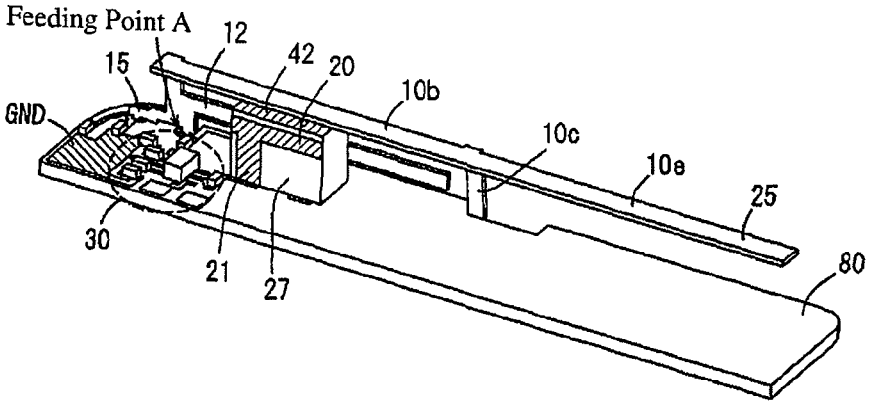
FIG. 31 is a perspective view showing a still further example of the antenna devices of the present invention.
Figure 32:
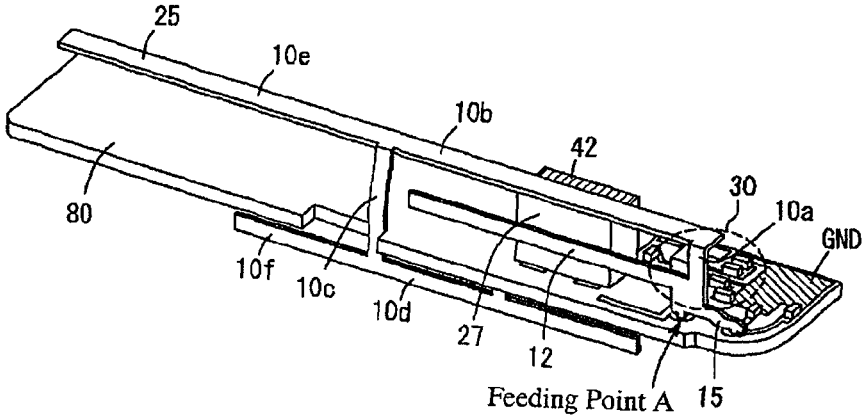
FIG. 32 is a perspective view showing a still further example of the antenna devices of the present invention.

FIG. 30 shows the structure of the frequency-variable antenna circuit of Example 2, and FIGS. 31 and 32 shows its appearance. Explanation will be omitted on portions of this frequency-variable antenna circuit common to those in Example 1.

The structure of the antenna element is substantially the same as in Example 1 except that a region 10*f* is added as the first antenna element. Because the antenna element cannot be sufficiently long in a limited space in a casing of a cell phone, a resonance frequency of a fundamental mode is finely adjusted by the region 10*f* to expand the resonance frequency to a desired frequency. Because larger distance from a ground electrode is preferable to improve a radiation gain, a region 10*a* was set as high as about 4.5 mm from a main surface of the antenna board 80.

A wide surface of the region 10*b* of the first antenna element 10 extends in parallel with the main surface of the antenna board 80 toward the open end F, and the first antenna element 10 is bent at a point connecting the region 10*b* to the region 10*a* (bending point B), the region 10*a* extending vertically. The antenna board 80 has a substantially rectangular shape of 52 mm in length, 12 mm in width and 0.6 mm in thickness, and the region 10*b* extends along a longer side of the antenna board 80. The region 10*b* is as long as about 30 mm. Under the region 10*b*, a second antenna element 12 extends substantially in parallel in the same direction as the region 10*b*. The region 12*b* of the second antenna element 12 is as long as about 25 mm The region 10*e* (auxiliary line 25) of the first antenna element 10 having a length not exceeding a longitudinal end of the antenna board 80 extends to the open end F with the same height and direction as those of the region 10*b*. A region 10*c* vertically extends through a notch of the antenna board 80 to the opposite surface. An end of the region 10*c* splits to two regions 10*d*, 10*f*.

The region 10*f* extends substantially in parallel to a rear surface of the antenna board 80 in the same direction as the region 10*e*, with a length substantially half of the region 10*e*. The length of the region 10*f* functioning to adjust the fundamental frequency may be set from 0 mm to a considerable length, if necessary. The region 10*d* as long as about 20 mm extends substantially in parallel to the rear surface of the antenna board 80 toward the feeding point A in the same direction as the region 10*b*.

Mounted on the antenna board 80 is a dielectric chip (support) 27 in contact with the region 10*b* of the first antenna element 10 and the region 12*b* of the second antenna element 12. This structure provides stronger coupling between the region 10*b* of the first antenna element 10 and the region 12*b* of the second antenna element 12, adjusting and widening a resonance frequency in a high-frequency band. Because it is preferable to mount the dielectric chip 27 near the feeding point A, a side surface of the dielectric chip 27 on the side of the feeding point A is as distant as 4 mm from the feeding point A.

The dielectric chip 27 of 6 mm in length, 3 mm in width and 4 mm in height is provided with an electrode pattern 42 on a substantially entire upper surface, and the electrode pattern 42 is soldered to the region 10*b* of the first antenna element 10. Formed on a side surface (opposite to a surface in contact with the second antenna element 12) of the dielectric chip 27 is a strip-shaped electrode pattern of 5 mm in length and 1 mm in width for forming a coupling means 20. A longer side of the electrode pattern is as high as 3.5 mm from the bottom surface, resulting in a predetermined gap to the electrode pattern 22 for DC insulation. The electrode pattern of the coupling means 20 is connected to the frequency-adjusting means 30 on the antenna board 80 via a connecting line 21 on the same surface.

The frequency-adjusting means 30 substantially has an equivalent circuit shown in FIG. 10, which comprises a variable capacitance circuit Cv constituted by an FET switch SW of SP2T and capacitance elements C1, C2, and inductance elements L1-L3. The constants of the inductance elements L1, L2 are L1=15 nH, and L2=12 nH, and L3 is jumper-connected without using an inductance element. The capacitance elements C1, C2 have capacitance of C1=1 pF, C2=6 pF. Thus obtained was a multi-band antenna of 52 mm in length, 12 mm in width and 6 mm in height.

EXAMPLE 3

Figure 33:
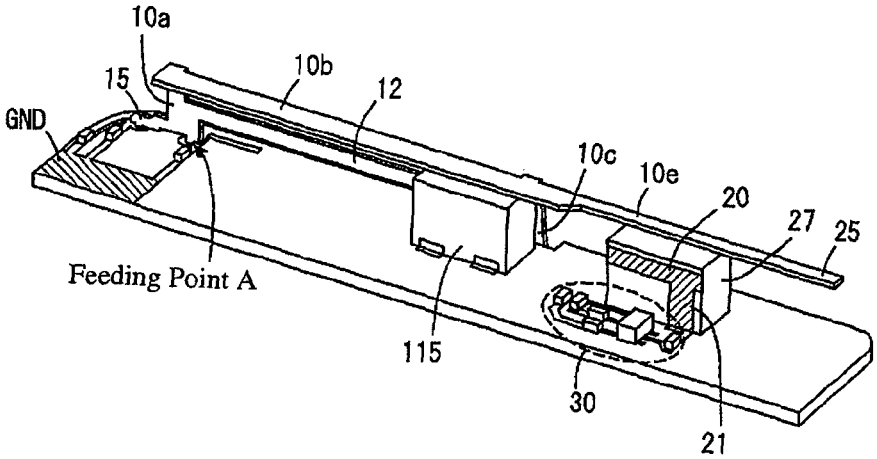
FIG. 33 is a perspective view showing a still further example of the antenna devices of the present invention.

FIG. 33 shows one example of antenna devices comprising a coupling means 20 disposed at a different position. Because the coupling means 20 is electromagnetically coupled to a region 10*e* of a first antenna element 10, a frequency-adjusting means 30 is separate from a feeding point A. Another dielectric chip 115 is disposed such that a region 10*b* of a first antenna element 10 is brought into contact with a region 12*b* of a second antenna element 12. Because the structures, etc. of the antenna element and the frequency-adjusting means 30 are the same as in Example 2, their explanation will be omitted.

Figure 34:
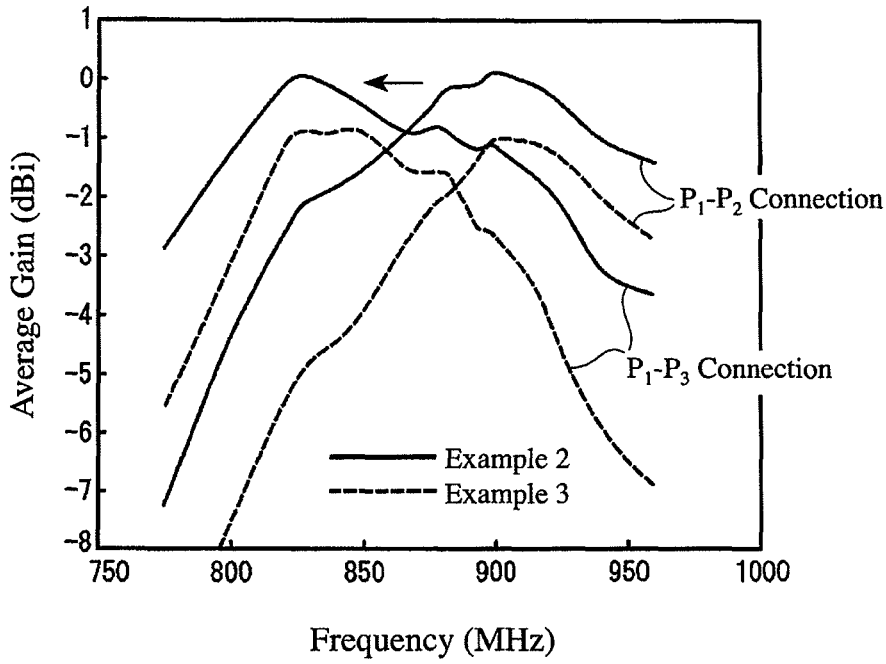
FIG. 34 is a graph showing the gain characteristics of the antenna device of the present invention.
Figure 35:
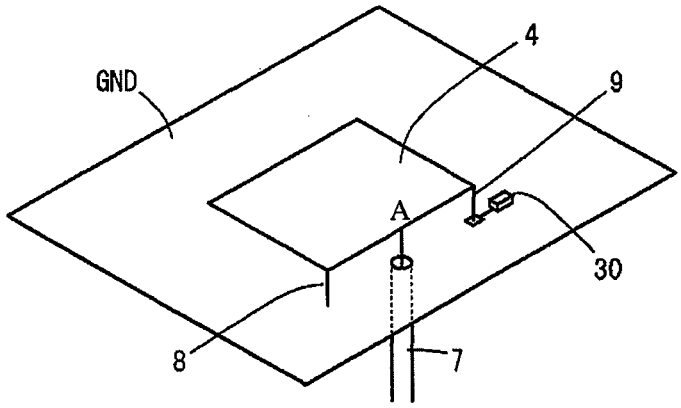
FIG. 35 is a perspective view showing one example of conventional antenna devices.
Figure 36:
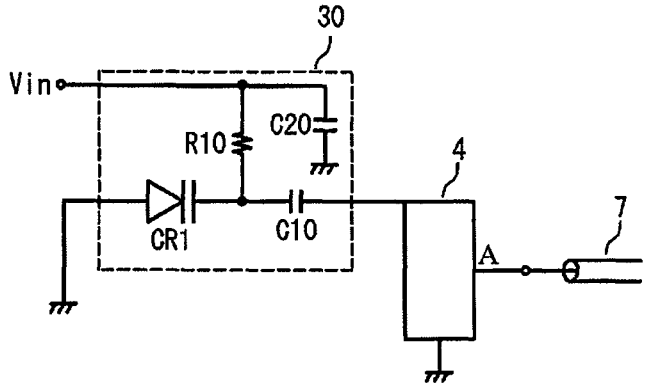
FIG. 36 is a view showing a frequency-adjusting means used in the conventional antenna device.
Figure 37:
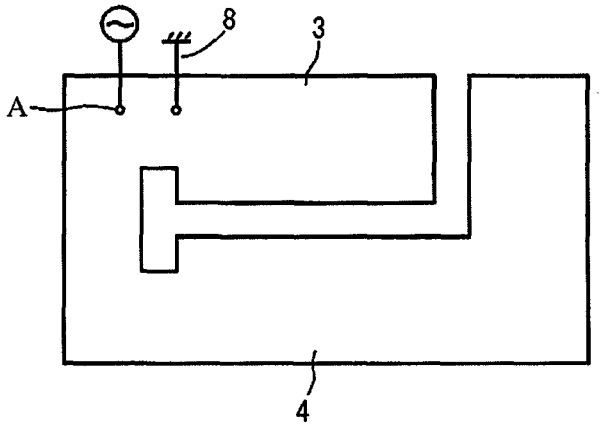
FIG. 37 is a view showing another example of conventional antenna devices.
Figure 38:
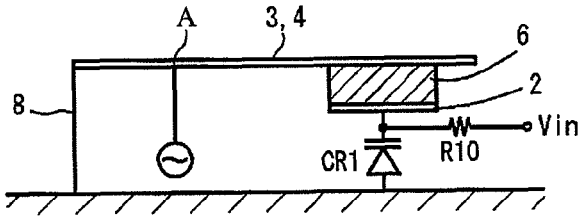
FIG. 38 is a cross-sectional view showing the antenna device of FIG. 37.
Figure 39:
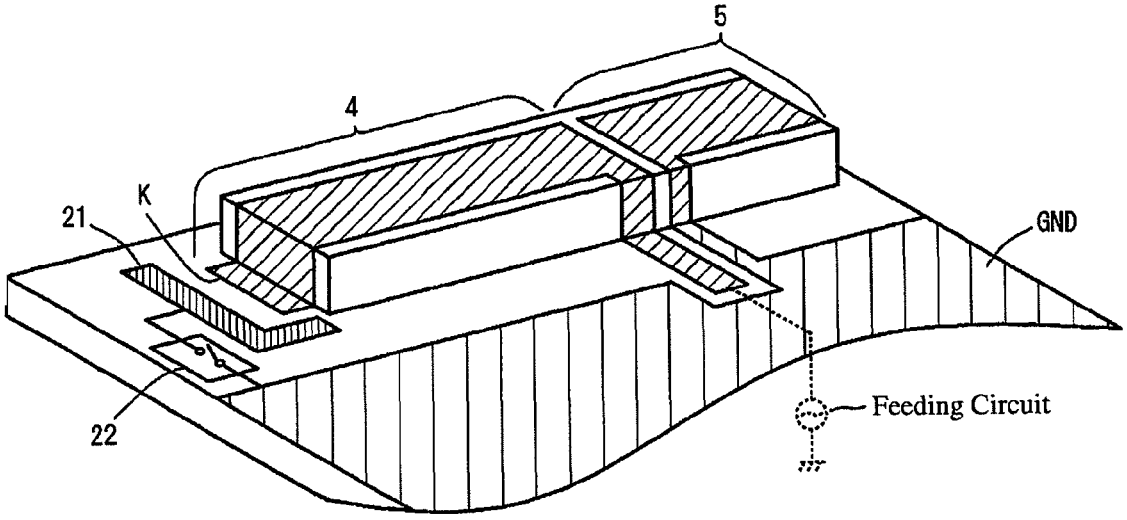
FIG. 39 is a perspective view showing a further example of conventional antenna devices.

FIG. 34 shows the dependence of average gain on a resonance frequency when the connecting path of a switch SW in a variable capacitance circuit Cv constituting the frequency-adjusting means 30 was changed in Examples 2 and 3. In both antenna devices of Examples, when the connection of the switch SW shown in FIG. 10 was changed from between ports P1 and P2 (C1 was connected) to between ports P1 and P3 (C2 was connected), the peak of average gain shifted toward a lower side. In FIG. 6, it shifts toward a lower side, if C2>C1. Though not shown, the switching of the connecting path changed a resonance frequency f1*r* and a peak position of VSWR in a low-frequency band, but did not substantially change a resonance frequency and average gain in a high-frequency band. Incidentally, the antenna device of Example 2 had higher gain by 0.5 dB or more than that of Example 3.

Effect of the Invention

Because the frequency-variable antenna circuit (device) of the present invention comprises a first antenna element and a frequency-adjusting means coupled to the first antenna element via a coupling means; the frequency-adjusting means having a parallel resonance circuit comprising a variable capacitance circuit and a first inductance element and a second inductance element series-connected to the parallel resonance circuit, it can adjust a resonance frequency in a desired range despite its small size. Also, because of first and second antenna elements sharing a feeding point, it can handle both low-frequency and high-frequency bands, thereby adjusting a resonance frequency such that it can receive signals in a wide frequency band.

What is claimed is:

1. A frequency-variable antenna circuit comprising:
- a first antenna element; and
- a frequency-adjusting means coupled to said first antenna element via a coupling means,
- said frequency-adjusting means comprising:
  - a parallel resonance circuit comprising a variable capacitance circuit and a first inductance element connected in parallel to said variable capacitance circuit; and
  - a second inductance element series-connected to said parallel resonance circuit,
- wherein the frequency-adjusting means is capacitively connected to the first antenna element via the coupling means.

2. The frequency-variable antenna circuit according to claim 1, further comprising:
- a control circuit for changing the capacitance of said variable capacitance circuit.

3. The frequency-variable antenna circuit according to claim 2, further comprising:
- a detection means for detecting the change of the resonance frequency of the first antenna element, said control circuit outputting, to said variable capacitance circuit, a control signal for changing capacitance in response to the change of the resonance frequency detected by said detection means.

4. The frequency-variable antenna circuit according to claim 1, further comprising:
- a second antenna element to provide multi-resonance in the frequency-variable antenna circuit, said second antenna element integral with and shorter than said first antenna element and sharing said feeding point with said first antenna element, said multi-resonance comprising the resonance of said first antenna element and the resonance of said second antenna element, so that said frequency-variable antenna circuit acts as a multi-band frequency-variable antenna circuit.

5. The frequency-variable antenna circuit according to claim 4, wherein said first antenna element and said second antenna element share a common path to said feeding point.

6. A wireless communications apparatus comprising the frequency-variable antenna circuit recited in claim 1.

7. An antenna device for constituting a frequency-variable antenna circuit, the antenna device comprising:
- a first antenna element; and
- a frequency-adjusting means coupled to said first antenna element via a coupling means,
- said frequency-adjusting means comprising:
  - a parallel resonance circuit comprising a variable capacitance circuit and a first inductance element connected in parallel to said variable capacitance circuit; and
  - a second inductance element series-connected to said parallel resonance circuit,
- said first antenna element having one end acting as a feeding point and the other end acting as an open end, part of said first antenna element being electromagnetically coupled to said coupling means, and said first antenna element is a first strip-shaped antenna element, wherein the frequency-adjusting means is capacitively connected to the first antenna element via the coupling means.

8. The antenna device according to claim 7, further comprising:

a second antenna element shorter than said first antenna element and sharing said feeding point with said first antenna element, to provide multi-resonance comprising the resonance of said first antenna element and the resonance of said second antenna element, so that said frequency-variable antenna circuit acts as a multi-band frequency variable antenna circuit, and said second antenna element is a second strip-shaped antenna element.

9. The antenna device according to claim 8, wherein part of said first antenna element is opposing said second antenna element with a predetermined gap between the part of said first antenna element and the second antenna element.

10. The antenna device according to claim 7, wherein said coupling means comprises a coupling electrode formed on a support made of a dielectric material or a soft-magnetic material.

11. The antenna device according to claim 10, wherein a connecting electrode is formed on said support with a predetermined gap to said coupling electrode, said connecting electrode connected to said first antenna element.

12. The antenna device according to claim 11, wherein said first antenna element and said coupling means are disposed on a mounting board separate from a main circuit board.

13. The antenna device according to claim 12, wherein said variable capacitance circuit is disposed on said mounting board, and connected to said coupling means via a connecting line.

14. A wireless communications apparatus comprising the antenna device recited in claim 7.

15. An antenna device comprising:

an antenna element; and a frequency-adjusting means disposed on said mounting board and connected to said coupling means, said frequency-adjusting means comprising:

a parallel resonance circuit; and a second inductance element series-connected to said parallel resonance circuit, said antenna element comprising first and second strip-shaped antenna elements integrally connected for sharing a feeding point, said second strip-shaped antenna element being shorter than said first strip-shaped antenna element, said coupling means disposed on a dielectric chip attached to said mounting board, and comprising a coupling electrode electromagnetically coupled to part of said first strip-shaped antenna element:

wherein the frequency-adjusting means is capacitively connected to the antenna element via the coupling means.

16. The antenna device according to claim 15, wherein said dielectric chip comprises a line for connecting said coupling electrode to said frequency-adjusting means.

17. The antenna device according to claim 16, wherein said coupling electrode is a strip electrode extending substantially in parallel to the first strip-shaped antenna element, part of said connecting line extending substantially in parallel to said coupling electrode.

18. The antenna device according to claim 15, wherein said first antenna element has a turned portion.

19. The antenna device according to claim 18, wherein an auxiliary line extends from said first antenna element at a bending point connected to said turned portion, said dielectric chip being in contact with part of the auxiliary line.

* * * * *